United States Patent [19]

Mihara et al.

[11] 4,212,672

[45] Jul. 15, 1980

[54] LITHOGRAPHIC SILVER HALIDE PHOTOSENSITIVE MATERIAL

[75] Inventors: Yuji Mihara; Haruo Takei; Noriyuki Inoue, all of Minami-ashigara, Japan

[73] Assignee: Fuji Photo Film Co., Ltd., Minami-ashigara, Japan

[21] Appl. No.: 924,108

[22] Filed: Jul. 12, 1978

[30] Foreign Application Priority Data

Jul. 12, 1977 [JP] Japan ..... 52-83230

[51] Int. Cl.[2] ..... G03C 5/04; G03C 1/08

[52] U.S. Cl. ..... 430/494; 430/945; 430/265; 430/302; 430/489; 430/487; 430/566; 430/572; 430/573

[58] Field of Search ..... 96/123, 122, 27 E, 95

[56] References Cited

U.S. PATENT DOCUMENTS

| | | | |
|---|---|---|---|
| 2,947,630 | 8/1960 | Jones | 96/123 |
| 2,961,318 | 11/1960 | Jones | 96/123 |
| 3,511,664 | 5/1970 | Nakazawa et al. | 96/123 |
| 3,923,517 | 12/1975 | Yamamoto et al. | 96/123 |
| 3,969,116 | 7/1976 | Shiba et al. | 96/27 E |
| 4,121,935 | 10/1978 | Nishina et al. | 96/27 E |

*Primary Examiner*—J. Travis Brown

*Attorney, Agent, or Firm*—Sughrue, Rothwell, Mion, Zinn and Macpeak

[57] ABSTRACT

A lithographic photosensitive material, suitable for exposure with light from a neon-helium laser, comprising a support having thereon a silver halide emulsion layer containing at least one sensitizing dye represented by the following general formula (I):

(I)

wherein Z and $Z_1$, which may be the same or different, each represents the non-metal atoms necessary for completing a 5-membered or 6-membered nitrogen-containing heterocyclic nucleus; R and $R_1$, which may be the same or different, each represents an alkyl group or an aryl group; Q and $Q_1$ together represent the non-metal atoms necessary for completing a 4-thiazolidinone, 5-thiazolidinone, or 4-imidazolidinone nucleus; L, $L_1$ and $L_2$ each represents a methine group; $n_1$ and $n_2$ each represents 0 or 1; X represents an anion; and m represents 0 or 1, with m being 0 when the dye forms an internal salt; with the silver halide emulsion layer or a layer adjacent the silver halide emulsion layer containing at least one compound represented by the following general formula (II):

$$D_1—A—D_2 \qquad (II)$$

wherein $D_1$ and $D_2$, which may be the same or different, each represents a condensed polycyclic aromatic heterocyclic residue or an aromatic heterocyclic substituted amino group, wherein the polycyclic aromatic heterocyclic residue or the aromatic heterocyclic substituted amino group may contain an $—SO_3M$ group wherein M represents a hydrogen atom or a cation; and —A— represents a divalent aromatic residue which may contain an $—SO_3M$ group wherein M has the same meaning as above; with the proviso that when $D_1$ or $D_2$ does not contain an $—SO_3M$ group, —A— contains an $—SO_3M$ group; and with the silver halide photographic material containing at least one polyalkylene oxide compound capable of increasing infectious development.

10 Claims, No Drawings

LITHOGRAPHIC SILVER HALIDE PHOTOSENSITIVE MATERIAL

BACKGROUND OF THE INVENTION

1. Field of the Invention

The present invention relates to spectrally sensitized silver halide photographic materials and, more particularly, to lithographic silver halide photosensitive materials.

2. Description of the Prior Art

A lithographic photosensitive material is usually prepared by coating a silver halide photographic emulsion having high contrast on a support. After exposure of the lithographic photosensitive material, the material is processed in a specific super high contrast developer (hereinafter referred to as a lithographic developer) to provide an image composed of dots and lines having very high contrast, which is then used as a photographic original for printing.

One of the most important properties required for such a lithographic photosensitive material is the formation of high contrast and high density dots and lines exhibiting sharp distinction between the dark areas and the light areas.

A so-called scanner system image forming process is known wherein an original is scanned to expose a silver halide photosensitive material based on image signals, whereby a negative image or a positive image corresponding to the image of the original is formed. Examples of such scanner systems are a system wherein an image having a continuous gradation is formed using an ordinary silver halide photographic material and a system wherein a dot image is formed using a lithographic photosensitive material. In producing printing plates, the latter system now tends to be often used since the latter system provides images having excellent sharpness and resolving power and, further, by employing the latter system, the steps in producing the printing plate can be decreased and the amount of labor can be reduced. Scanner systems for forming such a dot image include a dot generator system using a dot generator and a screen scanner system for obtaining dot images using a contact screen. Exposure light sources for these scanner systems include a glow lamp, a xenon lamp, a mercury lamp, a tungsten lamp, etc. However, these light sources have the practical disadvantages of weak output and short life. To overcome these disadvantages of conventional light sources, a scanner system using a coherent laser light source as the exposure light source for the scanner system has recently been developed.

In some lasers, a ruby, neon-helium gas, argon gas, krypton gas, helium-cadmium gas, carbon dioxide, etc., are used as the medium for laser generation. Of these media, a stable output is obtained at the lowest cost when neon-helium gas is used as the medium for laser generation.

The wavelength of the laser light generated by a neon-helium laser is 632.8 nm and, hence, a lithographic silver halide photographic material for forming dot images with an electronic color separation scanner using neon-helium laser light as the light source must have the following properties. Firstly, the photographic material must have a high sensitivity for light of a wavelength of 632.8 nm; secondly, the material must have the capability for high-illumination short-period exposure which is a necessary condition for a scanner system; and thirdly, the material must be capable of producing dots of good quality. However, there are no conventional lithographic silver halide photosensitive materials which satisfy the three requirements described above.

Spectral sensitization, that is, the technique of incorporating certain kinds of sensitizing dyes into a silver halide photographic material to provide a sensitivity to light of a longer wavelength than that to which the silver halide is inherently sensitive, is a well-known technique in producing silver halide photographic emulsions. Spectral sensitization can be employed also to render silver halide sensitive to light from the high illumination light sources, in particular, a neon-helium laser light source, described above, but when cyanine dyes are used in a lithographic silver halide emulsion, it is generally difficult to obtain high sensitivity and high contrast when a silver halide photographic emulsion thus-sensitized is processed with a lithographic type developer.

Also, use of J-band type cyanine dyes for sensitizing silver halide emulsions to light from a neon-helium laser light source is described in Japanese Patent Application (OPI) No. 33,622/76 (The term "OPI" as used herein refers to a "published unexamined Japanese patent application"), but these J-band type cyanine dyes have the defects that the sensitization maximum thereof is at a wavelength much longer than 632.8 nm which is the wavelength of neon-helium laser light and further a large amount of residual color due to the dyes remains after processing.

Rhodacyanine dyes, some of which are disclosed in Japanese Patent Application (OPI) No. 62,425/75, are known as sensitizing dyes which have a sensitization maximum near the wavelength of neon-helium laser light and which result in less residual coloring due to the dyes after processing. However, these sensitizing dyes have the defect that it is difficult to obtain good dot quality in lithographic development using a silver halide photographic emulsion sensitized by such dyes. Therefore, production of lithographic photosensitive materials for use with high illumination light sources, in particular, a neon-helium laser light source, using spectral sensitization resulting in high sensitivity for high illumination light sources, in particular, a neon-helium laser light source, and also providing good dot quality in lithographic development is an important subject.

SUMMARY OF THE INVENTION

An object of this invention is to provide a lithographic silver halide photosensitive material for use with high illumination light sources, in particular, a neon-helium laser light source, having high sensitivity for neon-helium laser light.

Another object of this invention is to provide a lithographic silver halide photosensitive material for use with high illumination light sources, in particular, a neon-helium laser light source, having high sensitivity and providing high contrast photographic characteristics and excellent dot quality on lithographic development.

Still another object of this invention is to provide a lithographic silver halide photosensitive material with less variable photographic properties, in particular, light sensitivity and fog.

A further object of this invention is to provide an image forming process capable of providing excellent dot images on exposing a silver halide photographic material having a high sensitivity to light from a neon-helium laser source for a short period of time at high illumination intensity using a neon-helium laser source scanner followed by lithographic development.

The above-described objects of this invention are attained by the following embodiments of this invention.

According to one embodiment, this invention provides a lithographic silver halide photographic material comprising a support having thereon a silver halide emulsion layer containing at least one sensitizing dye represented by the following general formula (I):

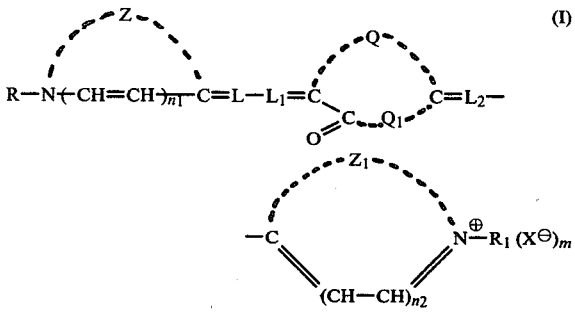

(I)

wherein Z and $Z_1$, which may be the same or different, each represents the non-metal atoms necessary for completing a 5-membered or 6-membered nitrogen-containing heterocyclic nucleus; R and $R_1$, which may be the same or different, each represents an alkyl group or an aryl group; Q and $Q_1$ together represent the non-metal atoms necessary for completing a 4-thiazolidinone nucleus, a 5-thiazolidinone nucleus, or a 4-imidazolidinone nucleus; L, $L_1$ and $L_2$ each represents a methine group; $n_1$ and $n_2$ each represents 0 or 1; X represents an anion; and m represents 0 or 1, with m being 0 when the sensitizing dye forms an inner salt; with the silver halide emulsion layer or a layer adjacent thereto containing at least one compound represented by the following general formula (II):

$$D_1—A—D_2 \qquad (II)$$

wherein $D_1$ and $D_2$, which may be the same or different, each represents a condensed polycyclic aromatic heterocyclic residue or an aromatic heterocyclic substituted amino group, in which the polycyclic aromatic heterocyclic residue or the aromatic heterocyclic substituted amino group may contain an $—SO_3M$ group wherein M represents a hydrogen atom or a cation; and —A— represents a divalent aromatic residue, which may contain an $—SO_3M$ group wherein M is as described above, with the proviso that when $D_1$ or $D_2$ does not contain an $—SO_3M$ group, —A— contains an $—SO_3M$ group; and with the silver halide photographic material containing at least one polyalkylene oxide compound capable of increasing infectious development.

According to another embodiment, this invention provides a lithographic silver halide photographic material as described above capable of being used to form dot images by a scanner system employing neon-helium laser light as the light source.

According to still another embodiment, this invention provides a lithographic silver halide photographic material as described above containing at least one polyalkylene oxide compound capable of increasing the infectious development effect for silver halide photographic materials.

According to a further embodiment, this invention provides a lithographic silver halide photographic material containing a polyalkylene oxide compound as defined below, with the lithographic silver halide photographic material containing at least one of the sensitizing dyes represented by the above-described general formula (I) in the silver halide emulsion and at least one of the compounds represented by the above-described general formula (II) in the silver halide emulsion layer or in an adjacent layer thereto.

According to still a further embodiment, this invention provides an image forming process capable of providing excellent dot images comprising exposing a silver halide photographic material as described above containing at least one polyalkylene oxide compound capable of increasing the infectious development effect for silver halide photographic materials and subjecting the exposed photographic material to a lithographic development to produce dot images.

DETAILED DESCRIPTION OF THE INVENTION

As described above, Z and $Z_1$ in the general formula (I) showing the sensitizing dyes which are used in this invention represent the non-metal atoms necessary for completing a 5-membered or 6-membered nitrogen-containing heterocyclic nucleus. Examples of suitable nitrogen-containing heterocyclic nuclei for Z and $Z_1$ are a thiazole nucleus (e.g., thiazole, 4-methylthiazole, 4-phenylthiazole, 4,5-dimethylthiazole, 4,5-diphenylthiazole, etc.), a benzothiazole nucleus (e.g., benzothiazole, 5-chlorobenzothiazole, 6-chlorobenzothiazole, 5-methylbenzothiazole, 6-methylbenzothiazole, 5-bromobenzothiazole, 6-bromobenzothiazole, 5-iodobenzothiazole, 6-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiazole, 5-trifluoromethylbenzothiazole, 5,6-dimethylbenzothiazole, 5-hydroxy-6-methylbenzothiazole, 5-ethoxy-6-methylbenzothiazole, tetrahydrobenzothiazole, etc.), a naphthothiazole nucleus (e.g., [2,1-d]thiazole, naphtho[1,2-d]thiazole, naphtho[2,3-d]thiazole, 5-methoxynaphtho[2,1-d]thiazole, 7-ethoxynaphtho[2,1-d]thiazole, 8-methoxynaphtho[2,1-d]thiazole, 5-methoxynaphtho[2,3-d]thiazole, etc.), a selenazole nucleus (e.g., 4-methylselenazole, 4-phenylselenazole, etc.), a benzoselenazole nucleus (e.g., benzoselenazole, 5-chlorobenzoselenazole, 5-phenylbenzoselenazole, 5-methoxybenzoselenazole, 5-methylbenzoselenazole, 5-hydroxybenzoselenazole, etc.), a naphthoselenazole nucleus (e.g., naptho[2,1-d]selenazole, naphtho[1,2-d]selenazole, etc.), an oxazole nucleus (e.g., oxazole, 4-methyloxazole, 5-methyloxazole, 4,5-dimethyloxazole, etc.), a benzoxazole nucleus (e.g., benzoxazole, 5-fluorobenzoxazole, 5-chlorobenzoxazole, 5-bromobenzoxazole, 5-trifluoromethylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxazole, 5-hydroxybenzoxazole, etc.), a naphthoxazole nucleus (e.g., naphtho[2,1-d]oxazole, naphtho[1,2-d]oxazole, naphto[2,3-d]oxazole, etc.), a 2-quinoline nucleus, an imidazole nucleus, a benzimidazole nucleus, a 3,3'-dialkylindolenine nucleus, a 2-pyridine nucleus, a thiazoline nucleus, and the like. It is particularly preferred for at least one of Z and $Z_1$ to be a thiazole nucleus, a thiazoline nucleus, an oxazole nucleus, or a benzoxazole nucleus.

Examples of suitable alkyl groups for R or $R_1$ in the above-described general formula (I) are alkyl groups having 1 to 4 carbon atoms, which may be straight chain or branched chain and unsubstituted or substituted. Examples of suitable unsubstituted alkyl groups are, e.g., a methyl group, an ethyl group, an n-propyl group, an n-butyl group, etc. Examples of suitable substituted alkyl groups are substituted alkyl groups wherein the alkyl moiety contains 1 to 4 carbon atoms, such as a hydroxyalkyl group (e.g., a 2-hydroxyethyl group, a 3-hydroxypropyl group, a 4-hydroxybutyl group, etc.), a carboxyalkyl group (e.g., a carboxymethyl group, a 2-carboxyethyl group, a 3-carboxypropyl group, a 4-carboxybutyl group, a 2-(2-carboxyethoxy)ethyl group, etc.), a sulfoalkyl group (e.g., a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[(3-sulfopropoxy)ethoxy]ethyl group, a 2-hydroxy-3-(3'-sulfopropoxy)propyl group, etc.), an aralkyl group wherein the alkyl moiety thereof preferably contains 1 to 5 carbon atoms and the aryl moiety thereof preferably is a phenyl group (e.g., a benzyl group, a phenethyl group, a phenylpropyl group, a phenylbutyl group, a p-tolylpropyl group, a p-methoxyphenethyl group, a p-chlorophenethyl group, a p-carboxybenzyl group, a p-sulfophenethyl group, a p-sulfobenzyl group, etc.), an aryloxyalkyl group wherein the alkyl moiety thereof preferably contains 1 to 5 carbon atoms and the aryl moiety thereof preferably is a phenyl group (e.g., a phenoxyethyl group, a phenoxypropyl group, a phenoxybutyl group, a p-methylphenoxyethyl group, a p-methoxyphenoxypropyl group, etc.), a vinylmethyl group and the like.

Suitable examples of aryl groups for R or $R_1$ are a phenyl group, a tolyl group, and the like.

L, $L_1$ and $L_2$ in the above-described general formula (I) is a methine group which may be an unsubstituted methine group or a substituted methine group of the formula

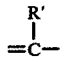

wherein R' represents an unsubstituted alkyl group having 1 to 4 carbon atoms (e.g., a methyl group, an ethyl group, etc.); a substituted alkyl group, for example, having 1 to 3 carbon atoms in the alkyl moiety such as an alkoxyalkyl group (e.g., wherein the alkoxy moiety has 1 to 3 carbon atoms such as a 2-ethoxyethyl group, etc.), a carboxyalkyl group (e.g., a 2-carboxyethyl group, etc.), an alkoxycarbonylalkyl group (e.g., wherein the alkoxy moiety has 1 to 3 carbon atoms such as a 2-methoxycarbonylethyl group, etc.), an aralkyl group (e.g., wherein the aryl moiety has 6 to 8 carbon atoms such as a benzyl group, a phenethyl group, etc.); an aryl group (e.g., an aryl group having 6 to 8 carbon atoms such as a phenyl group, a p-methoxyphenyl group, a p-chlorophenyl group, an o-carboxyphenyl group, etc.); and the like.

Q and $Q_1$ of the general formula (I) represent together the non-metal atoms necessary for completing a 4-thiazolidinone nucleus, a 5-thiazolidinone nucleus or a 4-imidazolidinone nucleus as described before and examples of suitable substituents which can be bonded to the nitrogen atom at the 3-position of the thiazolidinone nucleus or the 1- or 3-position of the imidazolidinone nucleus are an alkyl group having preferably 1 to 8 carbon atoms (e.g., a methyl group, an ethyl group, a propyl group, etc.), an allyl group, an aralkyl group wherein the alkyl moiety preferably has 1 to 5 carbon atoms and the aryl moiety preferably has 6 to 8 carbon atoms (e.g., a benzyl group, a p-carboxyphenylmethyl group, etc.), an aryl group having preferably 6 to 9 carbon atoms (e.g., a phenyl group, a p-carboxyphenyl group, etc.), a hydroxyalkyl group wherein the alkyl moiety has preferably 1 to 5 carbon atoms (e.g., a 2-hydroxyethyl group, etc.), a carboxyalkyl group wherein the alkyl moiety preferably has 1 to 5 carbon atoms (e.g., a carboxymethyl group, etc.), an alkoxycarbonylalkyl group wherein the alkyl moiety of the alkoxy moiety preferably has 1 to 3 carbon atoms and the alkyl moiety preferably has 1 to 5 carbon atoms (e.g., a methoxycarbonylethyl group, etc.) and the like.

Examples of suitable anions for X are a halogen ion (e.g., an iodine ion, a bromine ion, a chlorine ion, etc.), a perchlorate ion, a thiocyanate ion, a benzenesulfonate ion, a p-toluenesulfonate ion, a methylsulfate ion, an ethylsulfate ion, etc.

Of the sensitizing dyes represented by the general formula (I), the dyes represented by the following general formula (I-A) are particularly preferred:

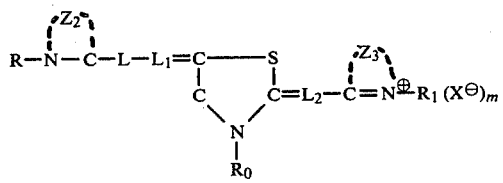

(I-A)

wherein $Z_2$ and $Z_3$, which may be the same or different, each represents the non-metal atoms necessary for completing a thiazole nucleus, a benzothiazole nucleus, or a benzoxazole nucleus; $R_0$ represents an alkyl group having 1 to 6 carbon atoms (e.g., a methyl group, an ethyl group, a propyl group, etc.), an unsubstituted or substituted aryl group or an unsubstituted or substituted aralkyl group wherein the alkyl moiety preferably has 1 to 5 carbon atoms (e.g., a benzyl group, a p-carboxyphenylmethyl group, etc.); and R, $R_1$, L, $L_1$, $L_2$, X and m each has the same meaning as in the general formula (I).

Specific examples of sensitizing dyes represented by the general formula (I) which can be used in this invention are illustrated below, although the present invention is not to be construed as being limited to these sensitizing dyes.

(I-1)
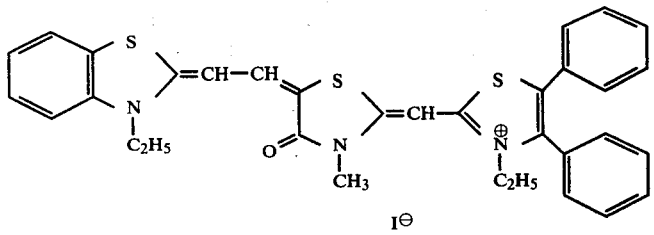
(I-2)
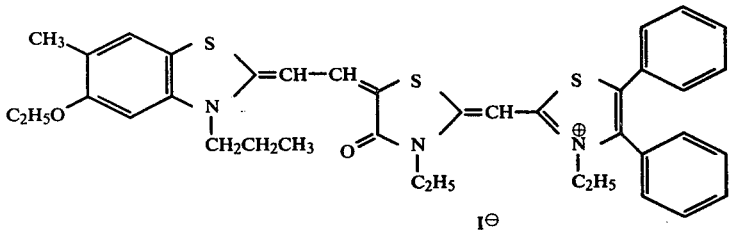
(I-3)
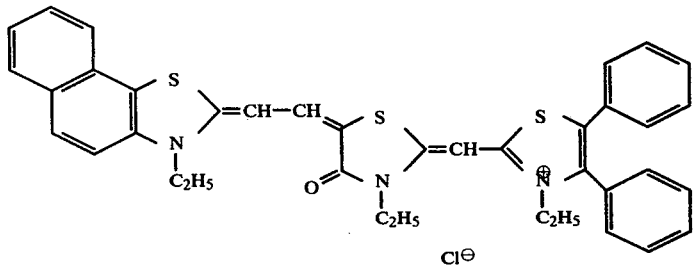
(I-4)
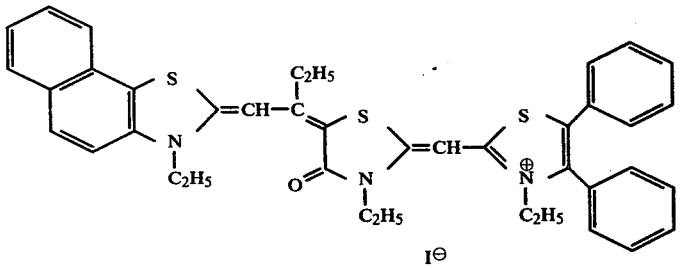
(I-5)
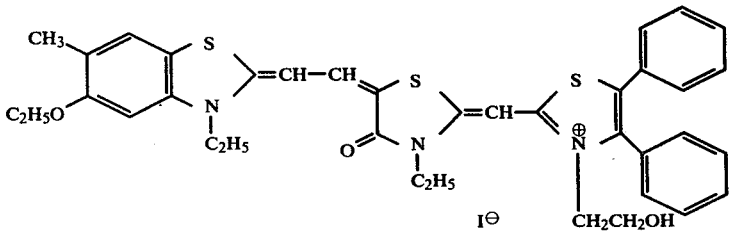
(I-6)
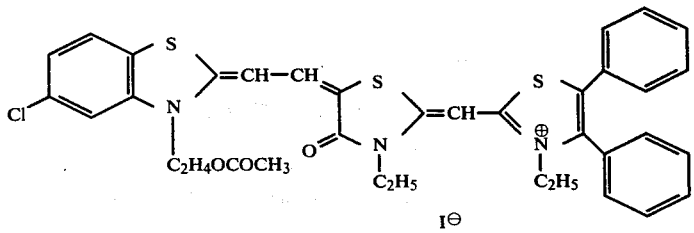

-continued
(I-7)
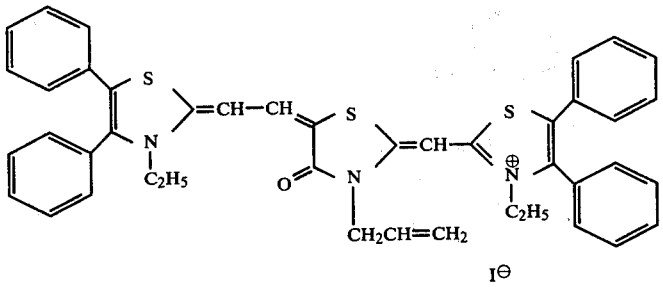
(I-8)
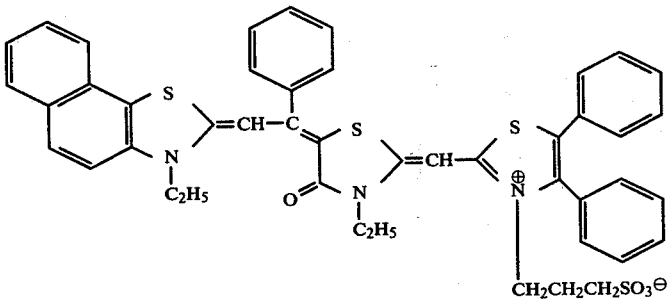
(I-9)
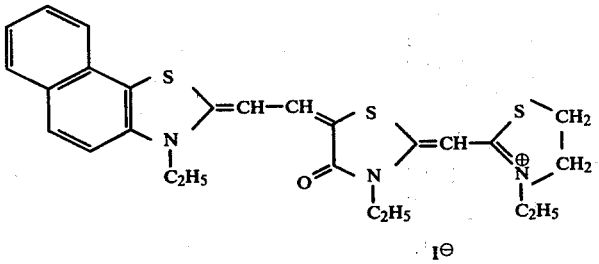
(I-10)
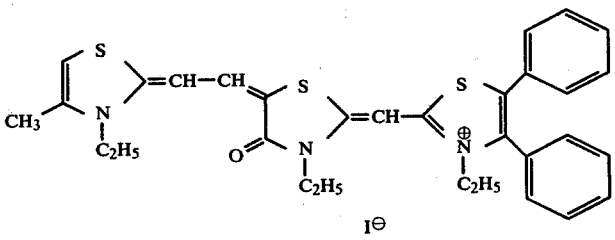
(I-11)
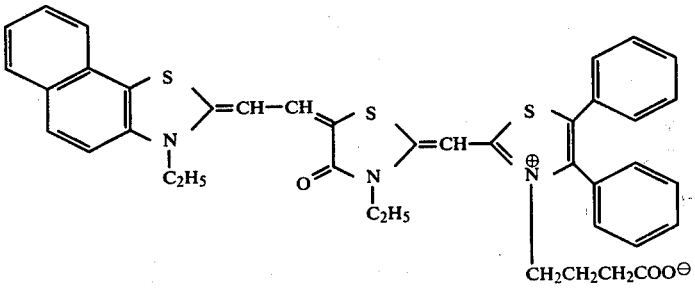

-continued
(I-12)
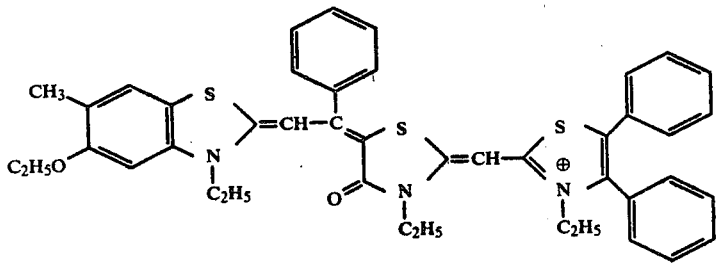
$I^{\ominus}$
(I-13)
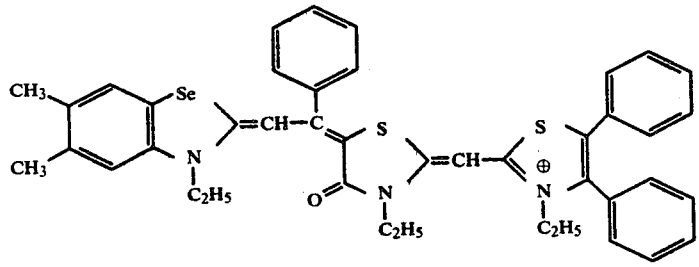
$I^{\ominus}$
(I-14)
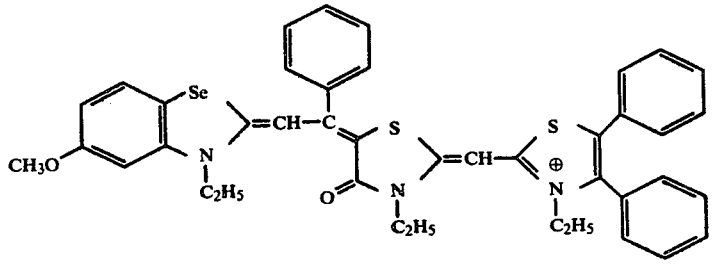
$I^{\ominus}$
(I-15)
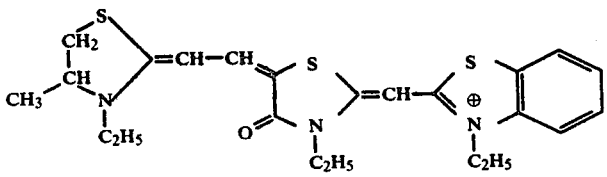
$I^{\ominus}$
(I-16)
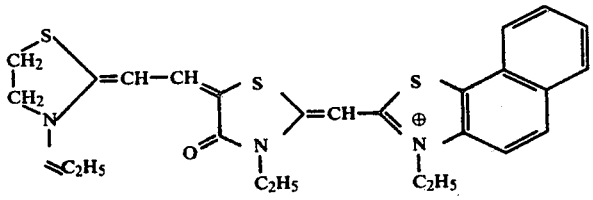
$I^{\ominus}$ -continued
(I-17)
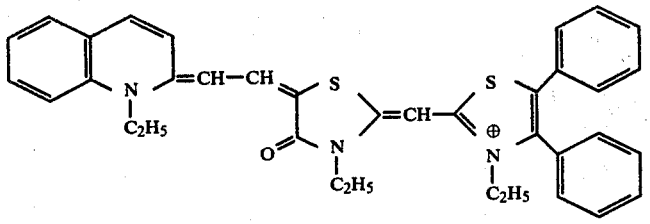
$I^{\ominus}$
(I-18)
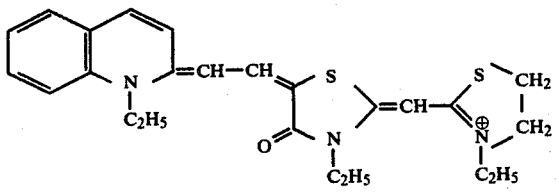
$I^{\ominus}$
(I-19)
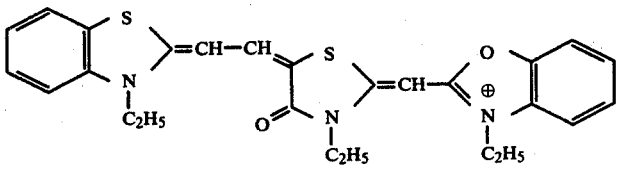
$I^{\ominus}$
(I-20)
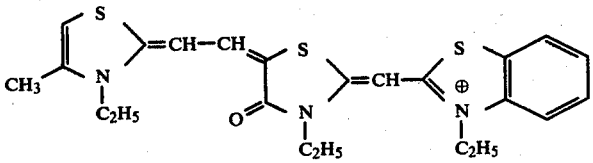
$I^{\ominus}$
(I-21)
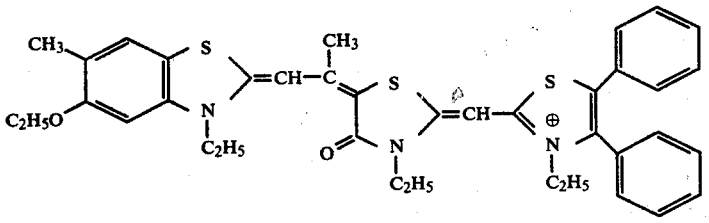
$I^{\ominus}$
(I-22)
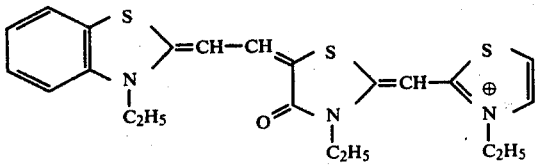
$I^{\ominus}$ -continued
(I-23)
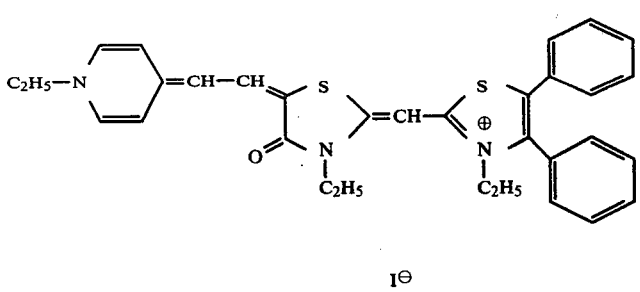
$I^{\ominus}$
(I-24)
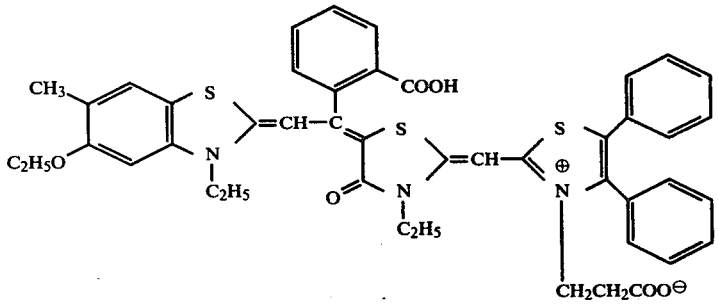
(I-25)
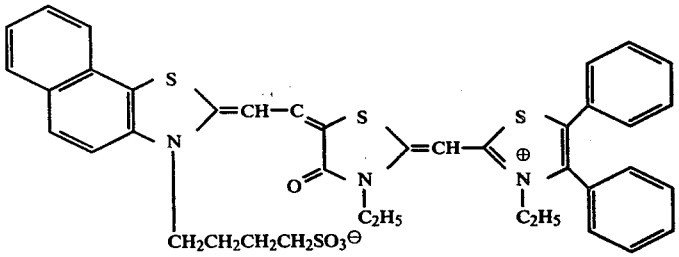
(I-26)
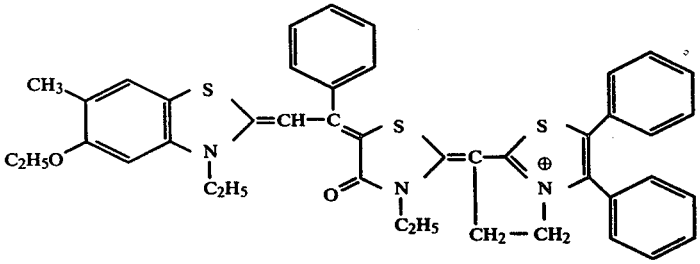
$Br^{\ominus}$
(I-27)
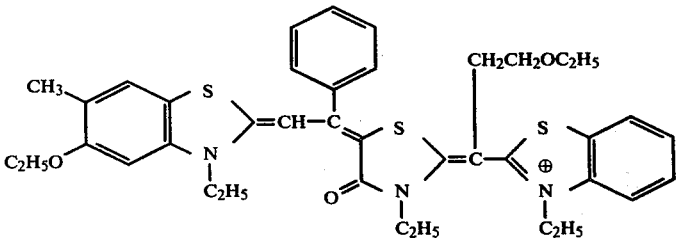
$I^{\ominus}$ -continued
(I-28)
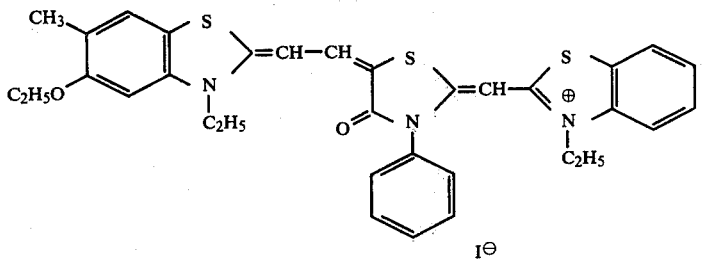
$I^{\ominus}$
(I-29)
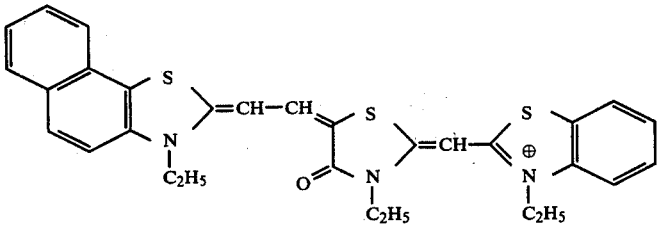
$I^{\ominus}$
(I-30)
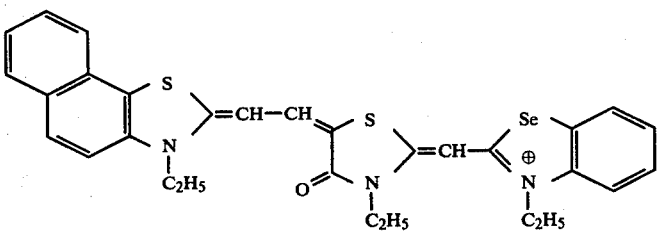
$I^{\ominus}$
(I-31)
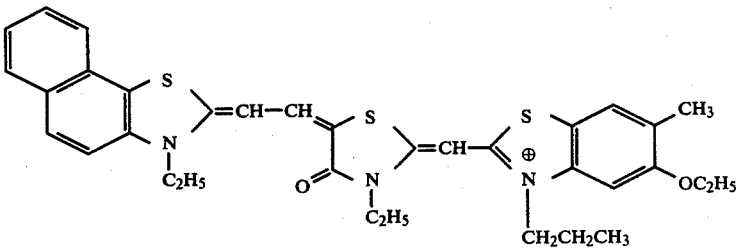
$I^{\ominus}$
(I-32)
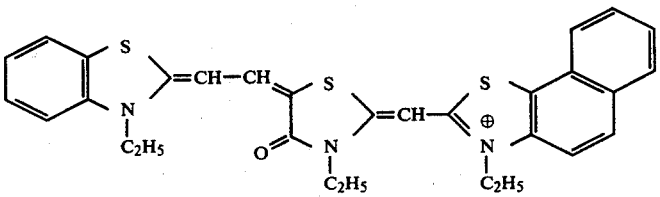
$I^{\ominus}$ -continued
(I-33)
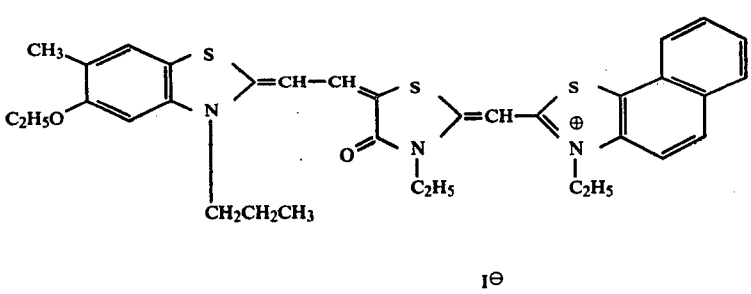
$I^{\ominus}$
(I-34)
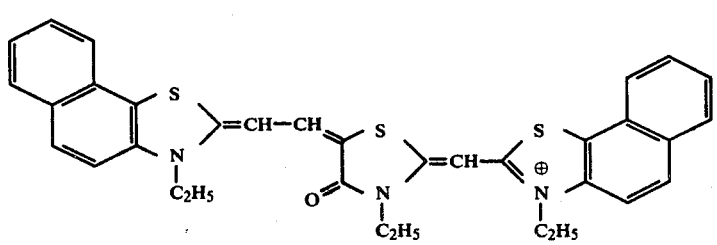
$I^{\ominus}$
(I-35)
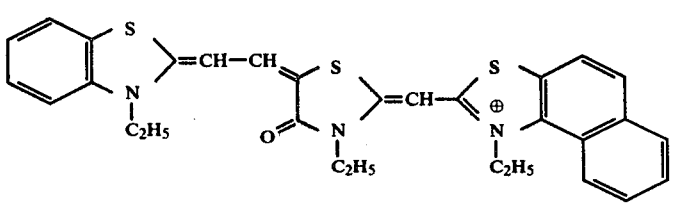
$I^{\ominus}$
(I-36)
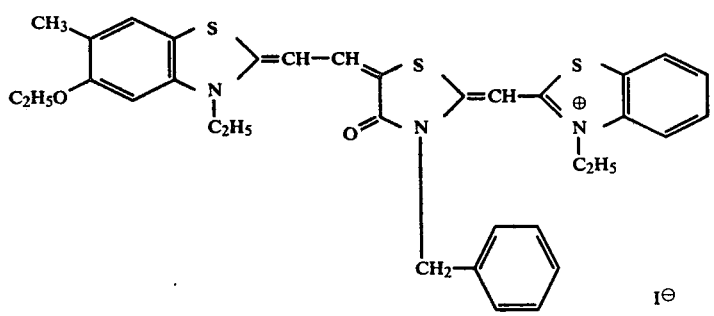
$I^{\ominus}$
(I-37)
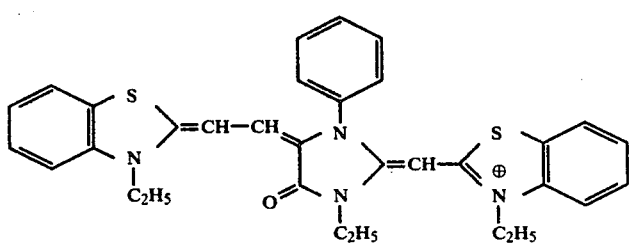
$I^{\ominus}$ -continued (I-38)

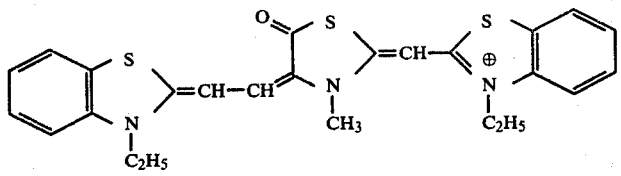

$I^{\ominus}$

The sensitizing dyes represented by the general formula (I) or the general formula (I-A) are well known and one skilled in the art can easily synthesize them according to procedures described in F. M. Hamer, *The Cyanine Dyes and Related Compounds,* Interscience Publishers (1964). The preparation of the compounds represented by the general formula (I) is also described in British Pat. Nos. 675,656, 721,203 and 675,654 and U.S. Pat. Nos. 2,475,163 and 2,535,992.

Examples of suitable condensed polycyclic aromatic heterocyclic residues represented by $D_1$ and $D_2$ in the general formula (II) include a 2-benzotriazole group and a 2-naphthotriazole group.

Examples of aromatic heterocyclic ring-substituted amino groups represented by $D_1$ and $D_2$ in the general formula (II) include a 1,3,5-triazin-2-ylamino group and a 1,3-diazin-2-ylamino group. These $D_1$ and $D_2$ groups may contain an $—SO_3M$ group. M can be a hydrogen ion or a cation and examples of suitable cations represented by M include a sodium ion and a potassium ion. The —A— group in the general formula (II) represents a divalent aromatic residue and may contain an $—SO_3M$ group wherein M has the same meaning as above. When $D_1$ or $D_2$ does not contain an $—SO_3M$ group, —A— must contain an $—SO_3M$ group. Exemplary residues for A include $—A_1—$ and $—A_2—$ as shown below.

-$A_1$-

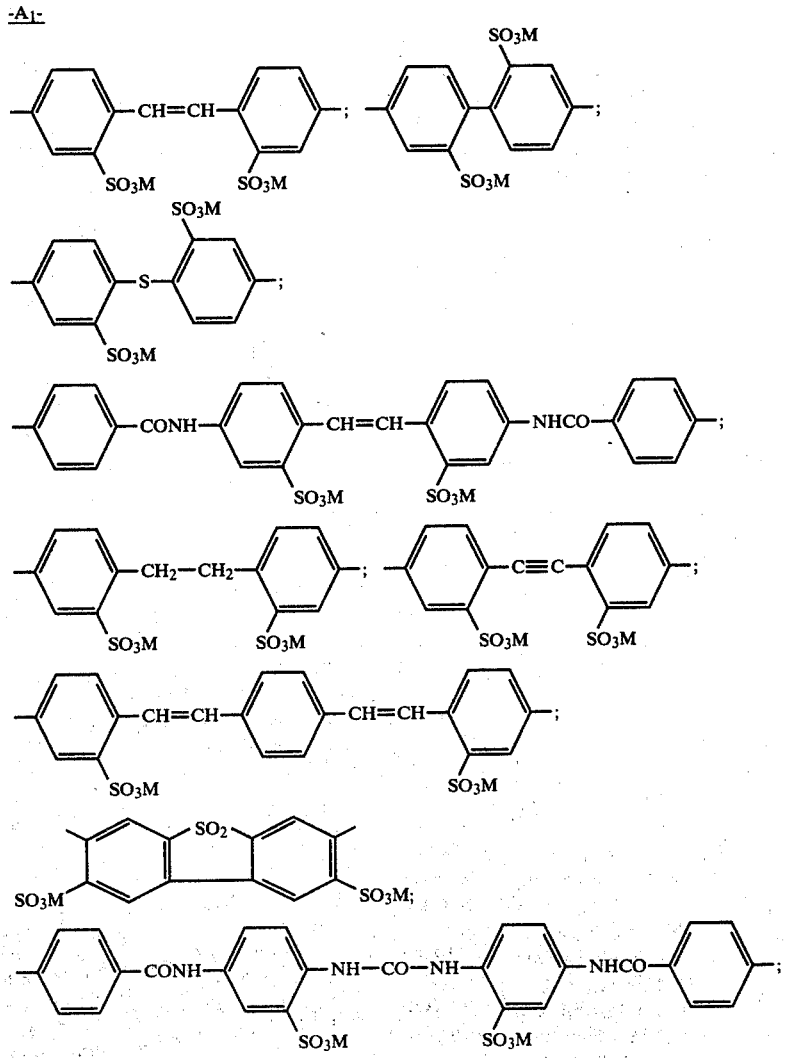

-$A_2$-

-continued

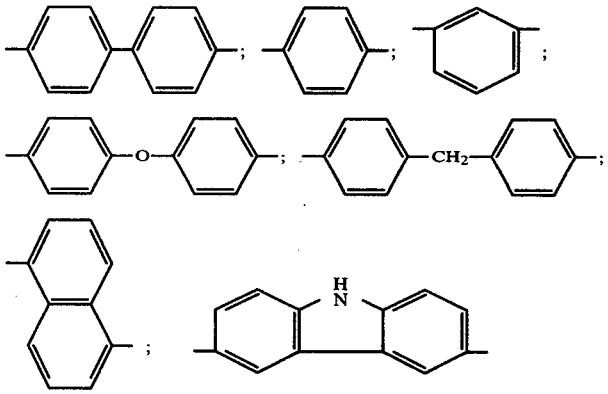

wherein, in a case of —$A_2$—, at least one of $D_1$ and $D_2$ contains a substituent containing an —$SO_3M$ group In the compounds shown by the general formula (II), particularly advantageous compounds are those represented by the following general formula (III) or (IV):

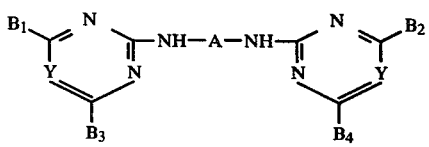

(III)

wherein —A— has the same meaning as in the general formula (II); Y represents =CH—, =$CB_5$— wherein $B_5$ represents a lower alkyl group having 1 to 3 carbon atoms (e.g., a methyl group, an ethyl group, etc.), a halogen atom, etc., or =N—; and $B_1$, $B_2$, $B_3$ and $B_4$, which may be the same or different, each represents a hydrogen atom, a hydroxy group, an alkoxy group (e.g., a methoxy group, an ethoxy group, etc.), a lower alkyl group having 1 to 3 carbon atoms (e.g., a methyl group, an ethyl group, etc.), an aryloxy group (e.g., having 6 to 8 carbon atoms such as a phenoxy group, an o-tolyloxy group, a p-sulfophenoxy group, etc.), a halogen atom (e.g., a chlorine atom, a bromine atom, etc.), a heterocyclic residue (e.g., a morpholinyl group, a piperidinyl group, etc.), an alkylthio group (e.g., wherein the alkyl moiety has 1 to 8 carbon atoms such as a methylthio group, an ethylthio group, etc.), a heterocyclicthio group (e.g., a benzothiazolylthio group, etc.), an arylthio group (e.g., wherein the aryl moiety has 6 to 8 carbon atoms such as a phenylthio group, a tolylthio group, etc.), an amino group, an alkylamino group which may be substituted (e.g., wherein the alkyl moiety has 1 to 14 carbon atoms such as a methylamino group, an ethylamino group, a propylamino group, a dimethylamino group, a diethylamino group, a dodecylamino group, a cyclohexylamino group, a β-hydroxyethylamino group, a di-(β-hydroxyethyl)amino group, a β-sulfoethylamino group, etc.), an arylamino group which may be substituted (e.g., wherein the aryl moiety has 6 to 8 carbon atoms such as an anilino group, an o-sulfoanilino group, an m-sulfoanilino group, a p-sulfoanilino group, an o-anisylamino group, an m-anisylamino group, a p-anisylamino group, an o-toluidino group, a p-toluidino group, an o-carboxyanilino group, an m-carboxyanilino group, a p-carboxyanilino group, a hydroxyanilino group, a disulfophenylamino group, a naphthylamino group, a sulfonaphthylamino group, etc.), a heterocyclicamino group (e.g., a 2-benzothiazolylamino group, a 2-pyridylamino group, etc.), an aryl group (e.g., having 6 to 8 carbon atoms such as a phenyl group, etc.), or a mercapto group, and when —A— does not have a sulfo (—$SO_3M$) group as a substituent, at least one of $B_1$, $B_2$, $B_3$ and $B_4$ has at least one sulfo group, which may be a free acid group or form a salt.

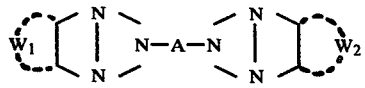

(IV)

wherein A has the same meaning as in the general formula (II) and $W_1$ and $W_2$, which may be the same or different, each represents the carbon atoms forming a benzene ring or a naphthalene ring, each of which may be substituted with at least one of $W_1$ or $W_2$ being substituted with a sulfo group or containing a substituent substituted with a sulfo group (e.g., 4-sulfobenzotriazole, 5-sulfobenzotriazole, 5,7-disulfonaphthotriazole, etc.).

Compounds of the general formula (III) wherein Y is —CH= provide particularly remarkable effects.

Typical examples of compounds represented by the general formula (II) which can be used in this invention are illustrated below. However, the present invention is not to be construed as being limited to these specific examples.

(II-1)
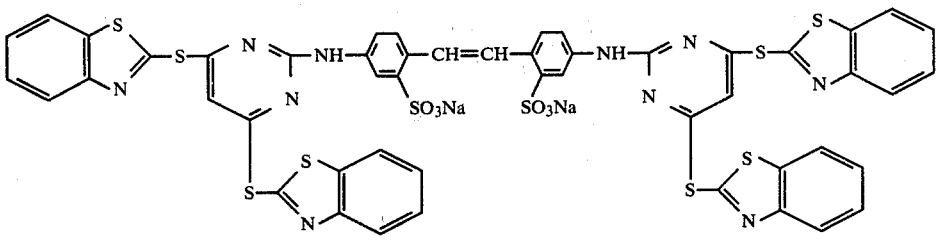
(II-2)
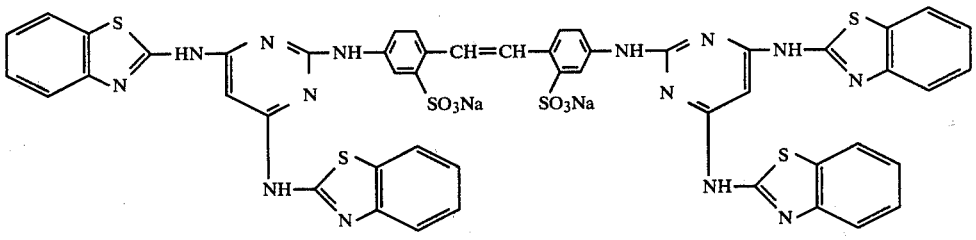
(II-3)
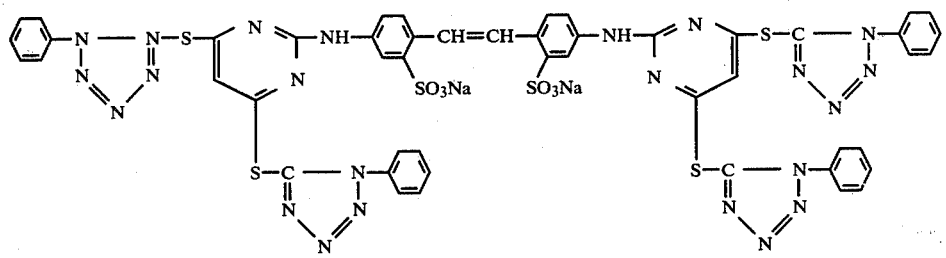
(II-4)
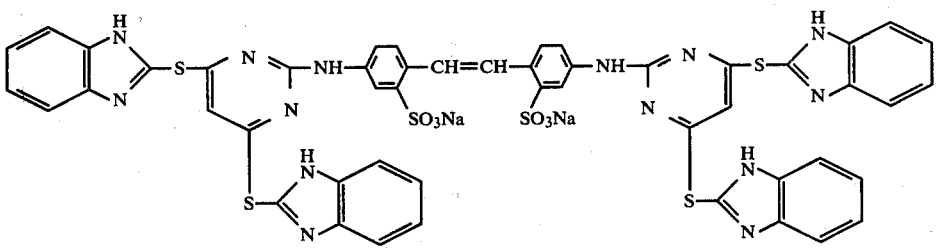
(II-5)
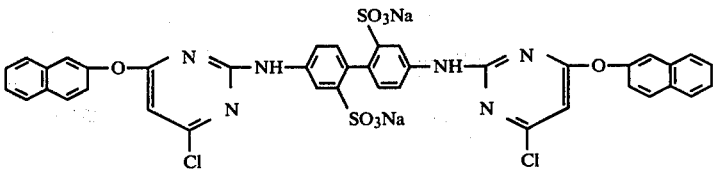
(II-6)
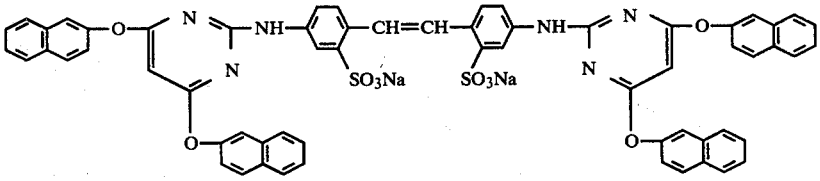
(II-7)
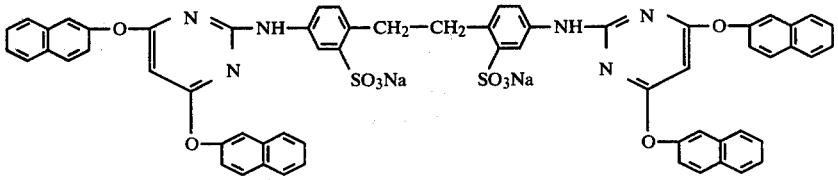

-continued
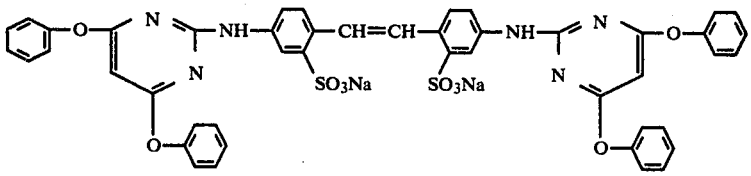
(II-8)
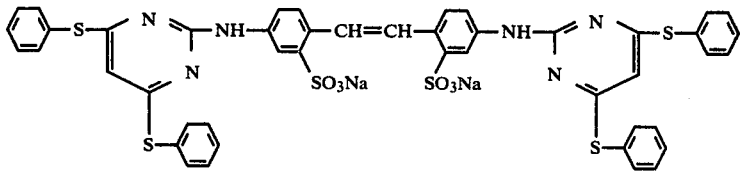
(II-9)
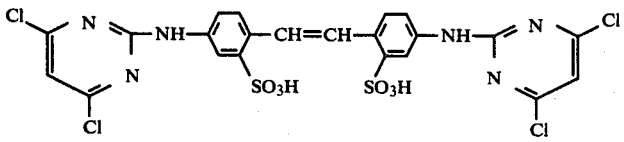
(II-10)
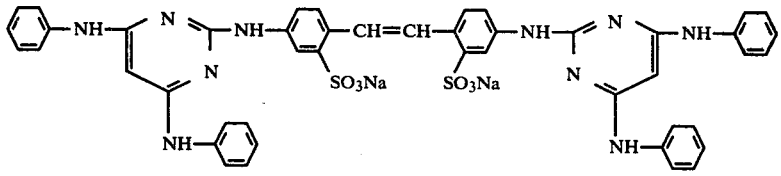
(II-11)
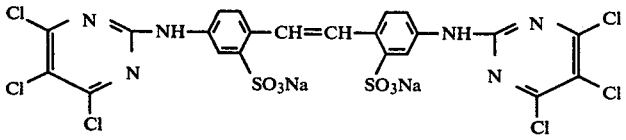
(II-12)
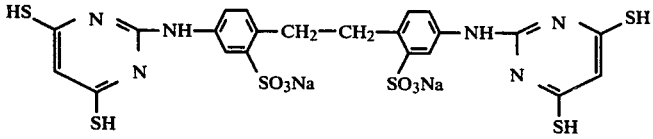
(II-13)
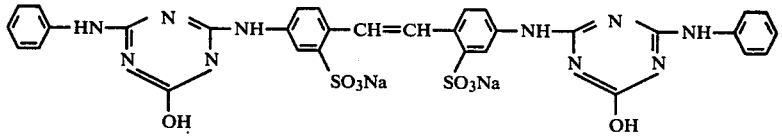
(II-14)
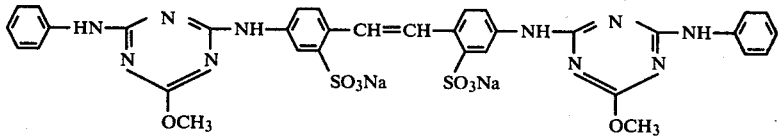
(II-15)
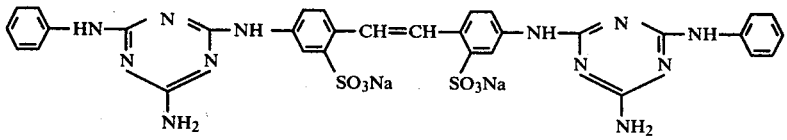
(II-16)

-continued
(II-17)
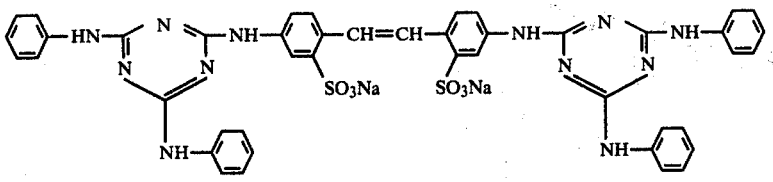
(II-18)
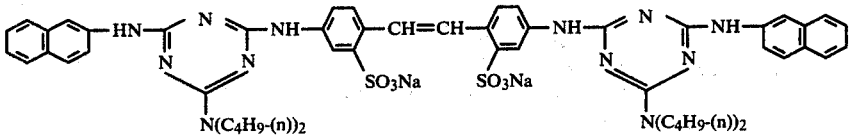
(II-19)
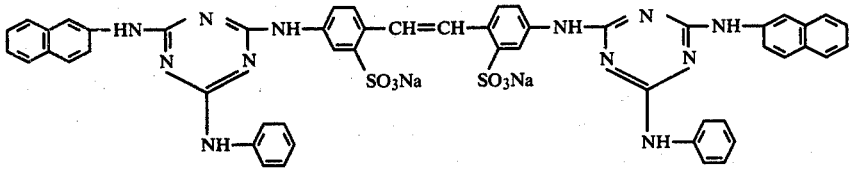
(II-20)
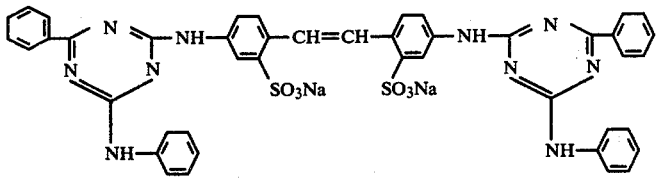
(II-21)
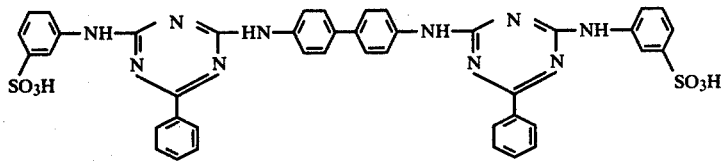
(II-22)
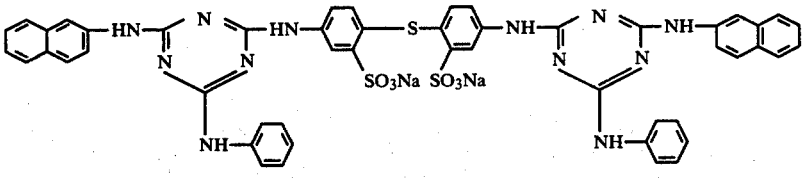
(II-23)
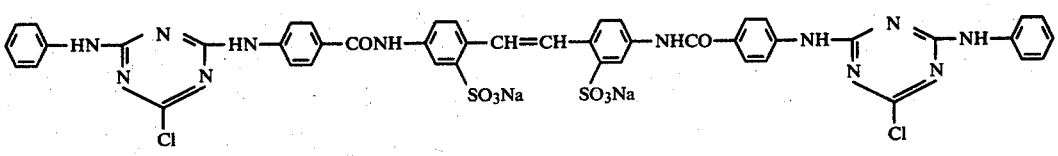
(II-24)
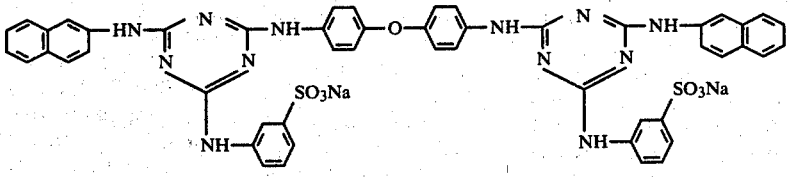
(II-25)
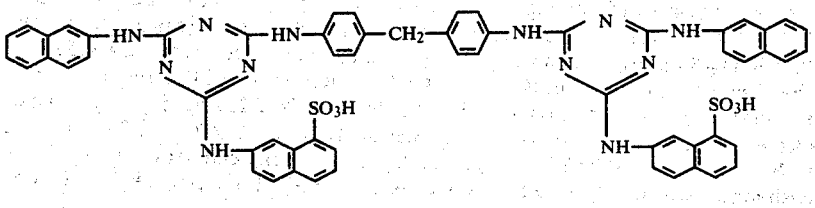

-continued (II-26)

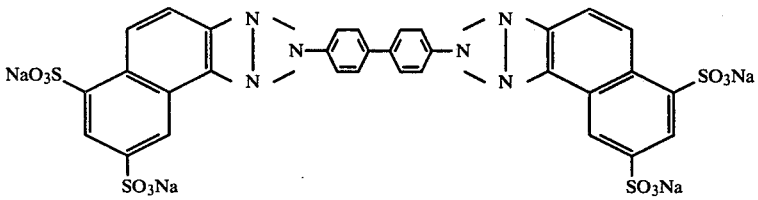

(II-27)

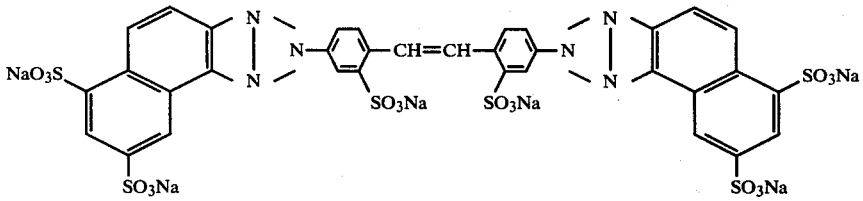

(II-28)

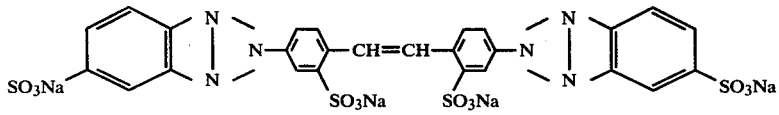

(II-29)

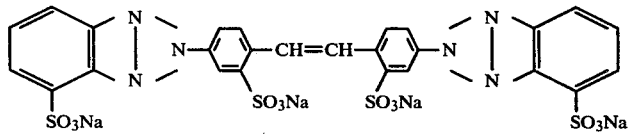

(II-30)

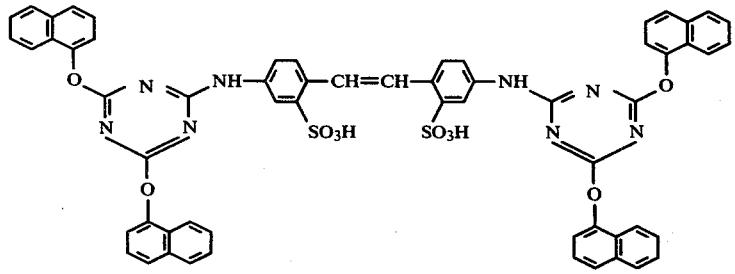

Some of the compounds represented by the general formula (II) described above are disclosed in, for example, U.S. Pat. No. 3,617,295 (corresponding to Japanese Pat. Publication No. 32,741/70) and the compounds of the general formula (II) which are not disclosed therein may be easily prepared by one skilled in the art by referring to the examples disclosed therein. The compounds represented by the general formula (II) also are described in U.S. Pat. No. 3,635,721 and German Pat. application (OLS) No. 2,557,916.

The sensitizing dyes of the general formula (I) used in this invention can be directly dispersed in a silver halide emulsion. Also, the sensitizing dyes may first be dissolved in an appropriate solvent such as methanol, ethanol, methyl Cellosolve, acetone, water, pyridine, or a mixture thereof and then the solution thereof added to the silver halide emulsion. In this case, ultrasonic waves may be utilized during the dissolution of the sensitizing dyes. Furthermore, methods for addition of sensitizing dyes to silver halide emulsions employed in this invention include a method wherein the sensitizing dyes are dissolved in a volatile organic solvent, the solution is dispersed in an aqueous hydrophilic colloid solution, and then the dispersion is added to a silver halide emulsion, e.g., as described in U.S. Pat. No. 3,469,987; a method wherein water-insoluble sensitizing dyes are dispersed in an aqueous solvent without being dissolved in an organic solvent and the dispersion is added to a silver halide emulsion, e.g., as described in Japanese Pat. Publication No. 24,185/71; a method wherein the sensitizing dyes are dissolved in a solution of a surface active agent and the solution is added to a silver halide emulsion, e.g., as described in U.S. Pat. No. 3,822,135; and the methods described in U.S. Pat. Nos. 2,912,343, 3,342,605, 2,996,287 and 3,429,835. Also, the sensitizing dyes of the general formula (I) may be uniformly dispersed in a silver halide emulsion before the emulsion is coated on a suitable support but the sensitizing dyes may, of course, be dispersed in a silver halide emulsion at any stage of preparing the silver halide emulsion.

Suitable polyalkylene oxide compounds which can be used in one embodiment of this invention are compounds having at least a polyalkylene oxide moiety capable of increasing the infectious development effect for silver halide photographic materials as described in, for example, U.S. Pat. Nos. 2,400,532, 3,294,537, 3,294,540, 3,516,830, 3,567,458, and 4,011,082, Japanese Pat. Publication No. 23,466/65, and Japanese Patent Application Nos. 24,783/76 and 76,741/76. Preferred examples of polyalkylene oxide compounds are the condensation product of a polyalkylene oxide having at least 10 alkylene oxide units, each alkylene oxide unit having 2 to 4 carbon atoms, such as ethylene oxide, propylene-1,2-oxide, butylene-1,2-oxide, etc., preferably ethylene oxide and a compound having at least one active hydrogen atom, such as water, an aliphatic alcohol, an aromatic alcohol, a phenol, a fatty acid, an organic amide, an organic amine, a hexitol derivative, etc., and a block copolymer of two or more polyalkylene oxides.

Suitable aliphatic alcohols and aromatic alcohols which can be used can be represented by the general formulae (V) to (VII):

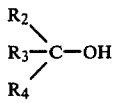
(V)

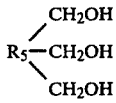
(VI)

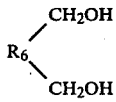
(VII)

wherein $R_2$, $R_3$ and $R_4$, which may be the same or different, each represents a hydrogen atom, an alkyl group having 1 to 30 carbon atoms (e.g., $-CH_3$, $-C_2H_5$, $-C_3H_7$, $-C_{11}H_{23}$, $C_{17}H_{35}$, $-C_{22}H_{45}$, etc.), an aryl group (e.g.,

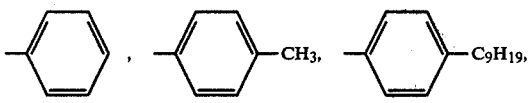

etc.) or an alkenyl group (e.g., $C_8H_{17}CH{=}CHC_7H_{14}-$); $R_5$ represents an alkantriyl group having 2 to 30 carbon atoms; and $R_6$ represents an alkandiyl group having 2 to 30 carbon atoms.

Suitable phenols which can be used can be represented by the general formulae (VIII) to (X):

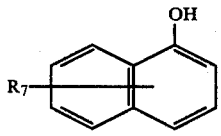
(VIII)

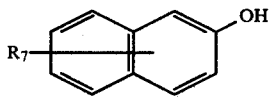
(IX)

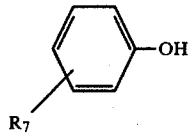
(X)

wherein $R_7$ represents a hydrogen atom, an alkyl group having 1 to 30 carbon atoms (e.g., $-CH_3$, $-C_2H_5$, $-C_3H_7$, $-C_9H_{19}$, $-C_{11}H_{23}$) or an alkenyl group (e.g., $C_8H_{17}CH{=}CHC_7H_{14}-$, etc.).

Suitable fatty acids which can be used can be represented by the general formulae (XI) and (XII):

$$R_8COOH \quad \text{(XI)}$$

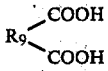
(XII)

wherein $R_8$ represents an alkyl group having 1 to 30 carbon atoms (e.g., $-CH_3$, $-C_2H_5$, $-C_8H_{17}$, $-C_{11}H_{23}$, $-C_{17}H_{35}$, $-C_{22}H_{45}$, etc.) or an alkenyl group (e.g., $C_8H_{17}CH{=}CHC_7H_{14}-$); and $R_9$ represents an alkandiyl group having 2 to 30 carbon atoms.

Suitable organic amides which can be used can be represented by the general formula (XIII):

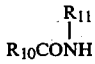
(XIII)

wherein $R_{10}$ represents an alkyl group having 1 to 30 carbon atoms (e.g., $-CH_3$, $-C_2H_5$, $-C_3H_7$, $-C_5H_{11}$, $C_9H_{19}$, $-C_{11}H_{23}$, $-C_{17}H_{35}$, $-C_{22}H_{45}$, etc.) or an aryl group (e.g.,

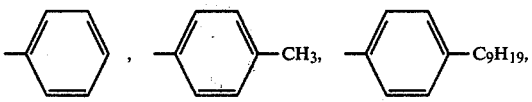

etc.) and $R_{11}$ represents a hydrogen atom, an alkyl group having 1 to 30 carbon atoms (e.g., $-CH_3$, $-C_2H_5$, $-C_3H_7$, $-C_5H_{11}$, $-C_9H_{19}$, $-C_{11}H_{23}$, $-C_{17}H_{35}$, $-C_{22}H_{45}$, etc.) or an aryl group (e.g.

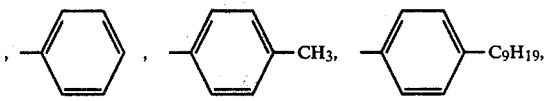

etc.).

Suitable organic amines which can be used can be represented by the general formula (XIV):

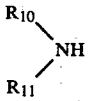
(XIV)

wherein $R_{10}$ and $R_{11}$ are the same as defined above for the general formula (XIII).

Suitable hexitol derivatives which can be used can be represented by the general formula (XV):

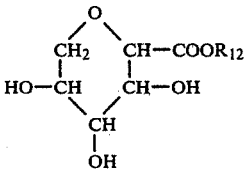
(XV)

wherein $R_{12}$ represents an alkyl group having 1 to 30 carbon atoms (e.g., $-C_2H_5$, $-C_9H_{19}$, $-C_{11}H_{23}$, $-C_{17}H_{35}$, $-C_{22}H_{45}$, etc.) or an aryl group (e.g.,

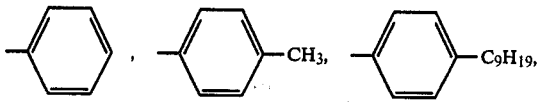

etc.).

Specific examples of suitable polyalkylene oxide compounds which can be used in this invention are as follows:

Polyalkylene glycols
Polyalkylene glycol alkyl ethers
Polyalkylene glycol aryl ethers
Polyalkylene glycol alkylaryl ethers
Polyalkylene glycol esters
Polyalkylene glycol fatty acid amides
Polyalkylene glycol amines
Polyalkylene glycol block copolymers
Polyalkylene glycol graft polymers The polyalkylene oxide compound may contain not only one polyalkylene oxide unit but also two or more polyalkylene oxide units in the molecule. In this case, each polyalkylene oxide chain may be composed of less than 10 alkylene oxide units but the sum of the alkylene oxide units in the molecule must be at least 10. When the compound has two or more polyalkylene oxide chains in the molecule, each of the chains may be composed of a different alkylene oxide unit such as, for example, ethylene oxide, propylene oxide, butylene oxide, and styrene oxide. The polyalkylene oxide compound used in this invention contains preferably from 14 to 100 alkylene oxide units.

The alkylene oxide compound which can be used in this invention generally has a molecular weight of about 300 to about 15,000, preferably 600 to 8,000.

Specific examples of polyalkylene oxide compounds which can be used in this invention are described below:

Polyalkylene Oxide-1.

$HO(CH_2CH_2O)_{10}H$

Polyalkylene Oxide-2.

$HO(CH_2CH_2O)_{90}H$

Polyalkylene Oxide-3.

$C_4H_9O(CH_2CH_2O)_{15}H$

Polyalkylene Oxide-4.

$C_{12}H_{25}O(CH_2CH_2O)_{15}H$

Polyalkylene Oxide-5.

$C_{18}H_{37}O(CH_2CH_2O)_{15}H$

Polyalkylene Oxide-6.

$C_{18}H_{37}O(CH_2CH_2O)_{40}H$

Polyalkylene Oxide-7.

$C_8H_{17}CH{=}CHC_8H_{16}O(CH_2CH_2O)_{15}H$

Polyalkylene Oxide-8.

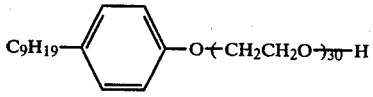

Polyalkylene Oxide-9.

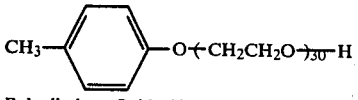

Polyalkylene Oxide-10.

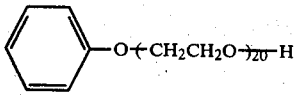

-continued

Polyalkylene Oxide-11.

$C_{11}H_{23}COO(CH_2CH_2O)_{80}H$

Polyalkylene Oxide-12.

$C_{11}H_{23}COO(CH_2CH_2O)_{24}OCC_{11}H_{23}$

Polyalkylene Oxide-13.

$C_8H_{17}CH(COO(CH_2CH_2O)_{9}H)(COO(CH_2CH_2O)_{9}H)$

Polyalkylene Oxide-14.

$C_{11}H_{23}CONH(CH_2CH_2O)_{15}H$

Polyalkylene Oxide-15.

$C_{12}H_{25}N((CH_2CH_2O)_{15}H)((CH_2CH_2O)_{15}H)$

Polyalkylene Oxide-16.

$C_{14}H_{29}N(CH_2)(CH_2CH_2O)_{24}H$

Polyalkylene Oxide-17.

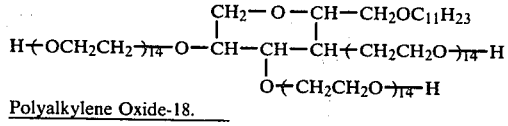

Polyalkylene Oxide-18.

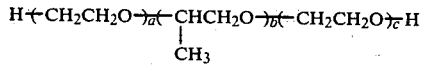

a + b + c = 50
b : a + c = 10 : 9

Polyalkylene Oxide-19.

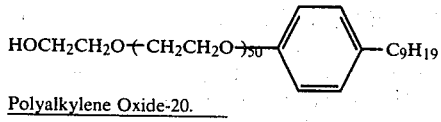

Polyalkylene Oxide-20.

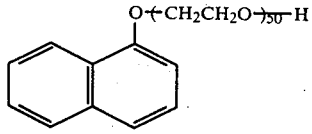

Polyalkylene Oxide-21.

a + c = 30
b = 14

Polyalkylene Oxide-22.

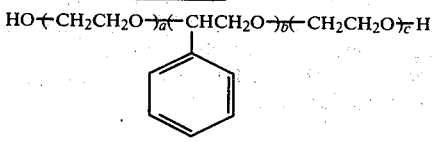

a + c = 50
c = 8

Polyalkylene Oxide-23.

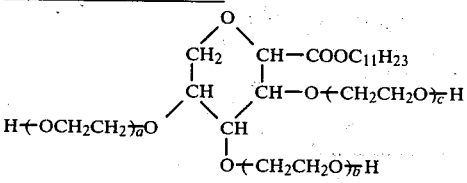

a + b + c = 30

These polyalkylene oxide compounds may be used individually or as a mixture thereof.

The polyalkylene oxide compound can be incorporated in a silver halide emulsion using conventional techniques. More specifically, the polyalkylene oxide compound can be added to a silver halide emulsion as an aqueous solution thereof at an appropriate concentration or as a solution in a low boiling organic solvent which is miscible with water at an appropriate stage before coating, preferably after chemical ripening of the silver halide emulsion. Furthermore, the polyalkylene oxide compound may be added to the same silver halide emulsion layer as the compound of the formula (I), to another silver halide emulsion layer, or to a non-light sensitive hydrophilic colloid layer.

The sensitizing dye of the general formula (I) used in this invention is advantageously employed in an amount of from about $1\times10^{-5}$ mole to about $2\times10^{-3}$ mole per mole of the silver halide in the silver halide emulsion.

Also, the compound of the general formula (II) used in this invention is advantageously employed in an amount of from about $2\times10^{-6}$ mole to about $5\times10^{-3}$ mole per mole of the silver halide in the silver halide emulsion.

The amount of the polyalkylene oxide compound employed is about 0.0005 g to about 10.0 g, preferably 0.005 g to 2.0 g, per mole of silver halide.

The molar ratio of the sensitizing dye of the general formula (I) to the compound of the general formula (II) advantageously used in this invention is a molar ratio of from about 4:1 to about 1:3, preferably from 2:1 to 1:2.

The lithographic photosensitive material of this invention is generally developed using a so-called infectious development for obtaining images of high edge gradient.

The lithographic developer (infectious developer) used for developing the lithographic photographic materials of this invention is fundamentally composed of an o- or p-dihydroxybenzene, an alkali agent, a small amount of free sulfite, and a sulfite ion buffer. The o- or p-dihydroxybenzene used as the developing agent can be selected as desired from those well known in the photographic field. Specific examples of suitable dihydroxybenzenes are hydroquinone, chlorohydroquinone, bromohydroquinone, isopropylhydroquinone, toluhydroquinone, methylhydroquinone, 2,3-dichlorohydroquinone, 2,5-dimethylhydroquinone, etc. Among these materials, hydroquinone is more preferably used.

These developing agents can be used individually or as a mixture thereof. A suitable amount of the developing agent used is about 1 to about 100 g, preferably 5 to 80 g, per liter of the developer.

The sulfite ion buffer is used in an amount effective for maintaining substantially constant the concentration of the sulfite ion in the developer and examples of sulfite ion buffers which can be used in this invention are aldehyde-sodium hydrogen sulfite addition products such as formaldehyde-sodium hydrogen sulfite, etc., ketone-alkali metal hydrogen sulfite addition products such as acetone-sodium hydrogen sulfite addition product, etc., and carbonyl hydrogen sulfite-amine condensation products such as sodium bis(2-hydroxyethyl)aminomethane sulfonate, etc. A suitable amount of the sulfite ion buffer used is about 13 to about 130 g per liter of the developer.

The concentration of the free sulfite ion in the developer used in this invention can be controlled by the addition of an alkali metal sulfite such as sodium sulfite. A suitable amount of the sulfite is generally less than about 5 g, preferably less than 3 g, per liter of the developer, although the amount may be as a matter of course larger than about 5 g.

In many cases, it is preferred for the developer to contain an alkali metal halide (in particular, a bromide such as sodium bromide or potassium bromide) as a development controlling agent. It is preferred for the amount of the alkali metal halide in the developer to be about 0.01 to about 10 g, particularly 0.1 to 5 g, per liter of the developer.

In order to maintain the pH of the developer above about 9 (particularly, at 9.7–11.5), an alkali agent is added to the developer. In general, sodium carbonate or potassium carbonate is employed in the developer as the alkali agent and various amounts of the alkali agents are used.

The lithographic photosensitive materials of this invention are quite advantageous since they are scarcely influenced by the ionic strength and the kind of the alkali agent in the developer and provide almost the same good photographic properties when they are processed using developers containing different alkali agents and ion strengths but superior photographic properties are obtained when they are developed in a developer having a low ionic strength.

The developer used in this invention may further contain, if desired, a pH buffer comprising a water-soluble acid (e.g., acetic acid, boric acid, etc.), an alkali (e.g., sodium hydroxide, etc.), and/or a salt (e.g., sodium carbonate, etc.). Certain alkalis not only render the developer alkaline but also act as a pH buffer and a development controlling agent. The developer may further contain preservatives such as diethanolamine, ascorbic acid, etc., and in particular, a lithographic developer containing about 10 to about 40 g/liter of diethanolamine is preferred since such a developer provides stable sensitivity and good dot images. The developer used in this invention may further contain an antifoggant such as benzotriazole, 1-phenyl-5-mercaptotetrazole, etc., and an organic solvent such as triethylene glycol, dimethylformamide, methanol, etc.

The developer used in this invention need only contain the above-described necessary components when used. That is, the developer components may comprise two or more parts which are mixed before use. For example, the developer components may be comprise a portion containing a developing agent and a portion containing an alkali and the developer is prepared at use by combining these two portions followed by dilution.

As a matter of course, a so-called powder type developer or a liquid type developer may be similarly used with good photographic properties being obtained.

In this invention, the developing temperature is preferably about 20° to about 40° C. but, as a matter of course, the development can be performed at temperatures other than within the above indicated range. In particular, preferred photographic properties are obtained at temperatures above 24° C.

The period of time of development depends upon the development temperature but is usually about 10 to about 250 seconds, particularly 10 to 150 seconds.

The development may be carried out manually or using an automatic processor but, in particular, preferred photographic properties can be obtained using an automatic processor. Where an automatic processor is used for the processing, the manner of conveying the photographic materials is not limited (e.g., using a roller conveyor, a belt conveyor, etc.). A conveyor type automatic processor usually used in the photographic field may be employed. The compositions of the processing liquids and the developing processes as described in, for example, U.S. Pat. Nos. 3,025,779, 3,078,024, 3,122,086, 3,149,551, 3,156,173, 3,224,356 and 3,573,914 may also be employed in this invention.

The silver halide emulsions used in this invention can be prepared using a neutralization method, an acid method, a single jet method, a double jet method, a controlled double jet method, etc., as described in, for example, C. E. K. Mees & T. H. James, *The Theory of the Photographic Process,* 3rd Edition, pages 31–43, Macmillan Co., New York (1967) and P. Grafkides, *Chimie Photographique,* 2nd Edition, pages 251–308, Paul Montel, Paris (1957).

Silver chlorobromide or silver chloroiodobromide containing at least 60 mole% (preferably at least 75 mole%) silver chloride and 0 to 5 mole% silver iodide is preferred as the silver halide composition used in this invention. There are no particular restrictions on the form, crystal habit, and grain size distribution of the silver halide grains used in this invention but silver halide grains having grain sizes below about 0.7 micron are preferred.

The sensitivity of the silver halide emulsions can be increased using a gold compound such as a chloroaurate, gold trichloride, etc.; a salt of a noble metal such as rhodium, iridium, etc.; a sulfur compound capable of forming silver sulfide by reaction with a silver salt; or a reducing material such as a stannous salt, an amine, etc.

Gelatin, denatured gelatin, gelatin derivatives, synthetic hydrophilic polymers, etc., may be used in this invention as the binder for the silver halides.

The silver halide emulsion layers or other layers of the lithographic photosensitive materials of this invention may contain, for the purposes of improving the dimensional stability of the photographic materials and improving the properties of the films or layers, a polymer latex of a homopolymer or copolymer of monomers such as alkyl acrylates, alkyl methacrylates, acrylic acid, glycidyl acrylates, etc., as described in U.S. Pat. Nos. 3,411,911, 3,411,912, 3,142,568, 3,325,286 and 3,547,650 and Japanese Patent Publication No. 5331/70.

The silver halide emulsions used in this invention may contain an anti-foggant such as 4-hydroxy-6-methyl-1,3,3a,7-tetrazaindene, 3-methylbenzothiazole, 1-phenyl-5-mercaptotetrazole as well as various heterocyclic compounds, mercury-containing compounds, mercapto compounds and also conventional anti-foggants well known in the photographic field as described in Japanese Patent Application (OPI) Nos. 81,024/74, 6306/75 and 19,429/75 and U.S. Pat. No. 3,850,639.

In the lithographic silver halide photographic materials of this invention, the sensitizing dyes of the general formula (I) may be used together with conventional cyanine dyes such as cyanine, merocyanine, carbocyanine, etc, dyes.

The photographic materials of this invention may further contain inorganic or organic hardening agents. For example, chromium salts (e.g., chrome alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (e.g., 2,3-dihydroxydioxane, etc.), active vinyl compounds (e.g., 1,3,5-triacryloylhexahydro-s-triazine, bis(vinylsulfonyl)methyl ether, etc.), active halogen compounds (e.g., 2,4-dichloro-6-hydroxy-s-triazine, etc.), mucohalic acids (e.g., mucochloric acid, phenoxy mucochloric acid, etc.), isoxazoles, dialdehyde starch, 2-chloro-6-hydroxytriazinylated gelatin, and the like can be used. The hardening agents may be used individually or as a mixture thereof. Other specific examples of hardening agents which can be used in this invention are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427 and Japanese Patent Publication Nos. 7,133/69 and 1,872/71.

The silver halide emulsions used in this invention may further contain surface active agents in addition to the polyalkylene oxide compounds according to this invention described above as coating aids as well as for improving the photographic properties.

Examples of surface active agents which can be used for these purposes are natural surface active agents such as saponin, etc.; nonionic surface active agents such as alkylene oxides (such as the surface active agents described in Japanese Patent Application (OPI) Nos. 156,423/75 and 69,124/74), glycidols, etc.; anionic surface active agents such as carboxylic acids, sulfonic acids (e.g., the surface active agents described in U.S. Pat. No. 3,415,649), phosphoric acids, sulfuric acid esters, phosphoric acid esters, etc.; and amphoteric surface active agents such as aminoacids, aminosulfonic acids, aminoalcohols, etc.

Furthermore, in this invention, the compounds as described in, for example, U.S. Pat. Nos. 3,288,613, 3,333,959, 3,345,175 and 3,708,303, British Patent 1,098,748, West German Patents 1,141,531 and 1,183,784, Japanese Patent Application (OPI) Nos. 99,031/74 and 56,436/77, and Japanese Patent Application Nos. 31,539/76 and 102,266/76 can be used as a development accelerator.

Other additives for silver halide emulsions and processes of producing photographic materials as described in *Product Licensing Index,* Vol. 92, 107–110 (1971) may also be employed in this invention.

The light exposure for obtaining photographic images in this invention can be performed using various light sources such as a tungsten lamp, a fluorescent lamp, a mercury lamp, a xenon flash lamp, a halide lamp, a light emitting diode, a cathode ray tube flying spot, a glow tube, tec. The exposure time can be from about 1/1,000 second to about 1 second and, as a matter of course, the exposure time may be shorter than about 1/1,000 second. For example, when a xenon flash lamp, a cathode ray tube, or a laser light is used as the light source, an exposure of about $1/10^4$ to about $1/10^6$ may be employed. An exposure longer than 1 second may also be employed. If desired, the spectral composition of the light used for the exposure may be controlled using color filters.

When the lithographic silver halide photographic materials of this invention are exposed using laser light, particularly neon-helium laser light, the effect (particularly, the effect of obtaining good dot images) of this invention is remarkable.

An effect or advantage of this invention is that the dot quality obtained with lithographic development is markedly improved by using the sensitizing dye represented by the general formula (I) together with the compound of the general formula (II). As shown in Example 1 described below, on considering that a silver halide photographic material containing only the sensitizing dye of the general formula (I) or a silver halide photographic material containing only the compound of the general formula (II) does not have improved dot quality, it is astonishing that the dot quality is remarkably improved by using the combination of the sensitizing dye of the general formula (I) and the compound of the general formula (II).

Also, when the silver halide photographic material containing the sensitizing dye of the general formula (I)

and the compound of the general formula (II) is subjected to a lithographic development, substantially no residual coloring due to the sensitizing dye is also obtained.

Furthermore, the lithographic silver halide photographic material containing a combination of the sensitizing dye of the general formula (I) and the compound of the general formula (II) has the effect that the change in photographic properties such as sensitivity, fog, etc., under high temperature and high humidity conditions is less as shown in Example 3 given hereinafter.

The invention will further be explained by reference to the following examples. Unless otherwise indicated herein, all parts, percents, ratios and the like are by weight.

EXAMPLE 1

A silver halide emulsion containing 80 mole% silver chloride, 19.5 mole% silver bromide, and 0.5 mole% silver iodide was subjected to gold sensitization and sulfur sensitization. The mean grain size of the silver halide grains thus-prepared was 0.35 micron.

The silver halide emulsion was divided into 18 portions with an amount of 625 g per portion and a sensitizing dye of the general formula (I) and a compound of the general formula (II) as shown in Table 2 below were added to each silver halide emulsion portion. Then, after further adding, in succession, 0.3 g/l mole AgX of 4-hydroxy-6-methyl-1,3,3a,7-tetrazaindene (stabilizer), 0.70 g/l mole AgX of Polyalkylene Oxide Compound-22, 2 g/l mole AgX of sodium dodecylbenzenesulfonate (surface active agent), 0.8 g/l mole AgX of mucochloric acid (hardening agent), and 40 g/l mole AgX of the polymer latex described in U.S. Pat. No. 3,525,620 to each silver halide emulsion, the emulsion was coated on a polyethylene terephthalate base in an amount of 5 g $Ag/m^2$ to provide photographic materials.

The samples thus-prepared were processed using one of the following two systems:

System (1): A grey negative contact screen (150 L/inch, made by Dai-Nippon Screen K.K.) was closely placed on the surface of the sample and then the sample was exposed through a step wedge having a step difference of 0.1 (log E) to white tungsten light (2860° K.) using an interference filter transmitting red light of a wavelength of 631.5 nm for 1 second.

System (2): The grey negative contact screen as used in System (1) was closely placed on the surface of the sample and the sample was exposed through the same step wedge as in System (1) using a neon-helium laser oscillator, (GAS LASER GLG 2034, made by Nippon Electric Co.) for 1/100,000 second.

The exposure amount onto the sample films was adjusted so that it was the same in System (1) and in System (2) using a neutral grey filter. In this case, however, since Samples 17 and 18 were not sensitive to light of a wavelength of about 632 nm, the samples were exposed without using the interference filter and the other samples were exposed as in System (1).

After exposure, the samples were developed using the lithographic developer shown in Table 1 below employing an automatic processor for 100 seconds at 27° C. Since the development period of time for obtaining the best dot quality differed by only a few seconds in Samples 1 to 18, the dot quality was compared after development for 100 seconds.

Table 1

| Developer Composition | | |
|---|---|---|
| Hydroquinone | 15 | g |
| Formaldehyde/Sodium Hydrogensulfite Addition Product | 50 | g |
| Potassium Carbonate | 50 | g |
| Sodium Sulfite | 2.5 | g |
| Potassium Bromide | 2.0 | g |
| Boric Acid | 5.0 | g |
| Sodium Hydroxide | 5.0 | g |
| Triethylene Glycol | 40 | g |
| EDTA . 2Na | 1.0 | g |
| Water to make | 1,000 | ml |

Table 2

| Sample No. | Compound (I) Kind | Compound (I) Amount* (g) | Compound (II) Kind | Compound (II) Amount* (g) | System (1) Exposure Relative Sensitivity | System (1) Exposure Dot Quality | System (2) Exposure Relative Sensitivity | System (2) Exposure Dot Quality |
|---|---|---|---|---|---|---|---|---|
| 1 | I-1 | 0.06 | — | — | 90 | D | 83 | D |
| 2 | " | " | II-6 | 0.07 | 170 | C | 160 | B |
| 3 | " | " | " | 0.14 | 165 | B | 155 | A |
| 4 | " | " | II-17 | 0.08 | 155 | C | 140 | B |
| 5 | " | " | " | 0.16 | 160 | B | 135 | A |
| 6 | I-20 | 0.07 | — | — | 100 | D | 100 | D |
| 7 | " | " | II-6 | 0.08 | 170 | C | 180 | B |
| 8 | " | " | " | 0.16 | 175 | B | 170 | A |
| 9 | " | " | II-17 | 0.07 | 160 | C | 180 | B |
| 10 | " | " | " | 0.14 | 157 | B | 160 | A |
| 11 | I-19 | 0.05 | — | — | 105 | D | 107 | D |
| 12 | " | " | II-6 | 0.06 | 190 | C | 193 | B |
| 13 | " | " | " | 0.12 | 195 | B | 191 | A |
| 14 | " | " | II-17 | 0.07 | 180 | C | 183 | B |
| 15 | " | " | " | 0.14 | 185 | B | 185 | A |
| 16 | (A) | 0.08 | — | — | 85 | D | 87 | D |
| 17 | — | — | II-6 | 0.16 | — | D | — | — |
| 18 | — | — | — | — | — | D | — | — |

*per mole of silver halide

In the Table, Samples 1, 6, 11 and 16–18 are comparison samples and Samples 2–5, 7–10, 12–15 are samples of the invention.

After processing, the 10% dots (9/10 clear, 1/10 developed density), 50% dots (5/10 clear, 5/10 developed density), and 90% dots (1/10 clear, 9/10 developed density) of the samples were observed using a microscope of a degree of magnification of 100 and the dot quality was evaluated using a four-grade scale, wherein the best quality was indicated by A and the worst quality by D.

Also, the sensitivity was compared using the reciprocal of the amount of exposure required to obtain 50% dots and, in each of the systems, the sensitivity was expressed as a relative value to that of Sample 6 taken as 100.

As is clear from the results in this table, the dot qualities of Samples 1, 6 and 11 were poor while Samples 3, 5, 8, 10, 13 and 15 of this invention were superior in sensitivity and dot quality. Samples 2, 4, 7, 9, 12, and 14 containing Compound (II-6) or (II-7) in an amount of ½ of the proper amount showed the same sensitivity as that in the case of adding the proper amount of the compound but were slightly poorer in dot quality.

Also, the effect of improving the dot quality due to the combination of the sensitizing dye and Compound (II-6) or (II-17) was more marked in the exposure of System (2) than in the exposure of System (1).

Also, Sample 16 containing Compound (A) described in Japanese Patent Application (OPI) No. 32,622/76 and having the following structure Compound A:

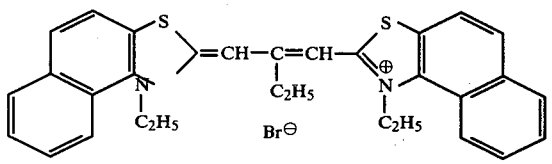

instead of the sensitizing dye of this invention had inferior sensitivity as well as dot quality.

EXAMPLE 2

To a silver halide emulsion prepared as described in Example 1 were added each of the polyalkylene oxide compounds shown in Table 3 below, and after adding thereto 0.07 g/l mole AgX of Sensitizing Dye (I-20) and 0.16 g/l mole AgX of Compound (II-6), each of the silver halide emulsions was coated on a polyethylene terephthalate film base in an amount of 5 g Ag/m² to provide photographic materials.

The samples were exposed as in System (1) or System (2) described in Example 1 and then developed as in Example 1.

After processing, the sensitivity and the dot quality of the samples were evaluated as in Example 1. In this case, the sensitivity of the samples was expressed relatively taking the sensitivity of Sample 6 as 100.

Table 3

| Sample No. | polyalkylene Oxide Compound: Compound | Amount* (g) | System (1) Exposure: Relative Sensitivity | Dot Quality | System (2) Exposure: Relative Sensitivity | Dot Quality |
|---|---|---|---|---|---|---|
| 19 | 8 | 0.8 | 165 | B | 170 | A |
| 20 | 9 | 0.7 | 170 | B | 168 | A |
| 21 | 14 | 0.6 | 175 | B | 177 | A |
| 22 | 15 | 0.5 | 170 | B | 175 | A |
| 23 | 18 | 0.3 | 180 | B | 178 | A |
| 24 | 19 | 0.5 | 190 | B | 195 | A |
| 25 | 20 | 0.5 | 190 | B | 196 | A |
| 26 | 21 | 0.4 | 195 | B | 195 | A |

*per mole of silver halide (AgX)

EXAMPLE 3

After subjecting Samples 6, 7, 8 and 16 prepared in the same manner as described in Example 1 to a forced deterioration test for 3 days under a temperature of 50° C. and a relative humidity of 65%, the phtographic materials were exposed as in System (2) and developed for 100 seconds at 27° C. using a lithographic developer having the same composition as that in Table 1 employing an automatic processor. On the other hand, samples which were not subjected to the forced deterioration test were also exposed and developed in the same manner as described above. The sensitivity was measured using the reciprocal of the amount of exposure required to obtain 50% dots and is shown in Table 4 together with the degree of fog. The sensitivity is shown as a relative value taking the sensitivity of Sample 6 which was not subjected to the forced deterioration test as 100.

In Samples 7 and 8 containing the sensitizing dye of the general formula (I) and the compound of the general formula (II) of this invention, the increase in fog and the reduction in sensitivity by the forced deterioration test were not observed. However, in Sample 6 containing only the sensitizing dye of the general formula (I) and Sample 16 containing Compound (A) described in Example 1, the increase in fog and the reduction in sensitivity by the forced deterioration test were marked.

Table 4

| Sample No. | Fresh: Fog | Fresh: Sensitivity | Forced Deterioration 50° C. 65% RH, 3 Days: Fog | Forced Deterioration: Sensitivity |
|---|---|---|---|---|
| 6 | 0.06 | 100 | 0.24 | 70 |
| 7 | 0.05 | 180 | 0.06 | 170 |
| 8 | 0.05 | 170 | 0.05 | 170 |
| 16 | 0.07 | 87 | 0.25 | 50 |

In the above table, Samples 6 and 16 are comparison samples and Samples 7 and 8 are samples of this invention.

While the invention has been described in detail and with reference to specific embodiments thereof, it will be apparent to one skilled in the art that various changes and modifications can be made therein without departing from the spirit and scope thereof.

What is claimed is:

1. A lithographic silver halide photographic material providing superior dot quality comprising a support having thereon a silver halide emulsion layer containing at least one sensitizing dye represented by the following general formula (I):

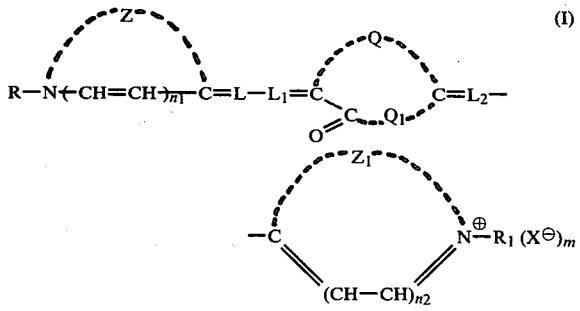

(I)

wherein Z and $Z_1$, which may be the same or different, each represents the non-metal atoms necessary for completing a 5-membered or 6-membered nitrogen-containing heterocyclic nucleus; R and $R_1$, which may be the same or different, each represents an alkyl group or an aryl group; Q and $Q_1$ together represent the non-metal atoms necessary for completing a 4-thiazolidinone nucleus, 5-thiazolidinone nucleus, or 4-imidazolidinone nucleus; L, $L_1$ and $L_2$ each represents a methine group; $n_1$ and $n_2$ each represents 0 or 1; and m represents 0 or 1, m being 0 when the dye forms an inner salt; with the silver halide emulsion layer or a layer adjacent the silver halide emulsion layer containing at least one compound represented by the following general formula (II):

$$D_1—A—D_2 \quad (II)$$

wherein $D_1$ and $D_2$, which may be the same or different, each represents a condensed polycyclic aromatic heterocyclic residue or an aromatic heterocyclic-substituted amino group, wherein the polycyclic aromatic heterocyclic residue or the aromatic heterocyclic-substituted amino group may contain an $—SO_3M$ group wherein M represents a hydrogen atom or a cation; and —A— represents a divalent aromatic residue, with the proviso that when $D_1$ or $D_2$ does not contain an $—SO_3M$ group, —A— contains an $—SO_3M$ group; and with the silver halide photographic material containing at least one polyalkylene oxide compound capable of increasing infections development.

2. The lithographic silver halide photographic material of claim 1, wherein the sensitizing dye represented by the general formula (I) is a sensitizing dye represented by the general formula (I-A):

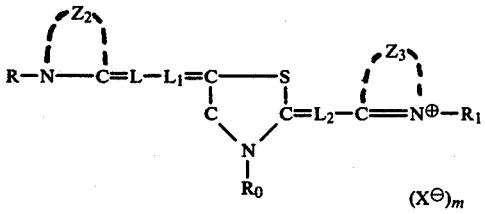

(I-A)

wherein $Z_2$ and $Z_3$, which may be the same or different, each represents the non-metal atoms necessary for completing a thiazole nucleus, a benzothiazole nucleus, or a benzoxazole nucleus; $R_0$ represents an alkyl group having 1 to 6 carbon atoms, an allyl group or an aralkyl group; and R, $R_1$, L, $L_1$, $L_2$, X and m have the same meaning as in the general formula (I).

3. The lithographic silver halide photographic material of claim 1, wherein the compound represented by the general formula (II) is a compound represented by the general formula (III):

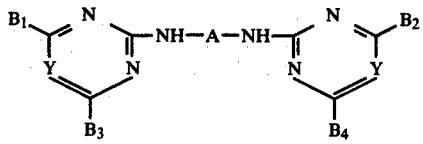

(III)

wherein —A— has the same meaning as in the general formula (II) in claim 1, —Y— represents =CH—, $=CB_5—$ or =N— wherein $B_5$ represents a lower alkyl group or a halogen atom; and $B_1$, $B_2$, $B_3$ and $B_4$, which may be the same or different, each represents a hydrogen atom, a hydroxy group, an alkoxy group, a lower alkyl group, an aryloxy group, a halogen atom, a heterocyclic nucleus, an alkylthio group, a heterocyclicthio group, an arylthio group, an amino group, an alkylamino group, an arylamino group, a heterocyclicamino group, an aryl group, or a mercapto group, and at least one of $B_1$, $B_2$, $B_3$ and $B_4$ must contain at least one sulfo group when —A— does not contain a sulfo group.

4. The lithographic silver halide photographic material of claim 3, wherein Y in the general formula (III) is —CH=.

5. The lithographic silver halide photographic material of claim 4, wherein the sensitizing dye represented by the general formula (I) is a sensitizing dye represented by the general formula (I-A):

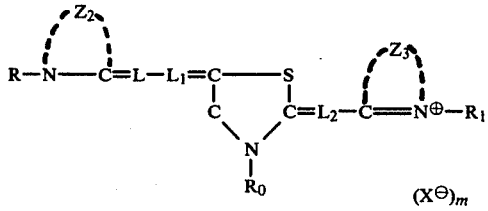

(I-A)

wherein $Z_2$ and $Z_3$, which may be the same or different, each represents the non-metal atoms necessary for completing a thiazole nucleus, a benzothiazole nucleus, or a benzoxazole nucleus; $R_0$ represents an alkyl group having 1 to 6 carbon atoms, an allyl group, or an aralkyl group; and R, $R_1$, L, $L_1$, $L_2$, X and m have the same meaning as in the general formula (I).

6. The lithographic silver halide photographic material of claim 1, wherein the molar ratio of the sensitizing dye represented by the general formula (I) to the compound represented by the general formula (II) is about 4:1 to 1:3.

7. The lithographic silver halide photographic material of claim 6, wherein the molar ratio of the sensitizing dye represented by the general formula (I) to the compound represented by the general formula (II) is 2:1 to 1:2.

8. The lithographic silver halide photographic material of claim 1, wherein photographic material contains a polyalkylene oxide compound having at least a polyalkylene oxide moiety capable of increasing the infectious development effect for silver halide photographic materials.

9. The lithographic silver halide photographic material of claim 8, wherein the polyalkylene oxide compound has a molecular weight of about 600 to about 8,000.

10. A process for forming images which comprises exposing the lithographic silver halide photographic material of claim 1 to neo-helium laser light using a scanner and then subjecting the exposed photographic material to a lithographic development, whereby superior dot images are obtained.

* * * * *